US006447984B1

(12) United States Patent
Tatsumi et al.

(10) Patent No.: US 6,447,984 B1
(45) Date of Patent: Sep. 10, 2002

(54) LIQUID DISCHARGE HEAD, METHOD OF MANUFACTURE THEREFOR AND LIQUID DISCHARGE RECORDING APPARATUS

(75) Inventors: Junji Tatsumi, Kawasaki; Hiroshi Sugitani, Machida; Masami Ikeda, Tokyo; Masami Kasamoto, Ayase; Hiroyuki Ishinaga, Tokyo; Yoshiaki Suzuki, Yokohama; Toshio Kashino, Fujisawa; Torachika Osada, Yamato; Shuji Koyama, Kawasaki; Haruhiko Terai, Yokohama; Masashi Miyagawa, Yokohama; Genji Inada, Yokohama; Hiroyuki Sugiyama, Sagamihara; Ken Ikegame, Tokyo; Hiroaki Mihara, Musashino; Miki Ito; Takashi Saito, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/498,626

(22) Filed: Feb. 7, 2000

(30) Foreign Application Priority Data

| | | |
|---|---|---|
| Feb. 10, 1999 | (JP) | 11-033270 |
| Feb. 10, 1999 | (JP) | 11-033271 |
| May 27, 1999 | (JP) | 11-148541 |
| Jul. 2, 1999 | (JP) | 11-189623 |

(51) Int. Cl.[7] ..... B41J 2/00; B41J 2/01; B41J 2/05; B41J 2/14

(52) U.S. Cl. ..... 430/320; 347/47; 347/54; 347/56; 347/65; 347/67; 156/230; 156/275.3

(58) Field of Search ..... 430/320; 347/47, 347/54, 56, 65, 67; 156/230, 275.3

(56) References Cited

U.S. PATENT DOCUMENTS

| | | | |
|---|---|---|---|
| 4,412,224 A | 10/1983 | Sugitani | 346/1.1 |
| 4,417,251 A | 11/1983 | Sugitani | 346/1.1 |
| 4,437,100 A | 3/1984 | Sugitani et al. | 346/1.1 |

(List continued on next page.)

FOREIGN PATENT DOCUMENTS

| | | |
|---|---|---|
| EP | 0 576 007 | 12/1993 |
| EP | 0 578 329 | 1/1994 |
| EP | 0 786 342 | 7/1997 |

(List continued on next page.)

OTHER PUBLICATIONS

Patent Abstracts of Japan, vol. 017, No. 217, Apr. 28, 1993, JP 04–353456 A (Dec. 8, 1992).

*Primary Examiner*—John A. McPherson
(74) *Attorney, Agent, or Firm*—Fitzpatrick, Cella, Harper & Scinto

(57) ABSTRACT

A method for manufacturing a liquid discharge head comprises the steps of providing a head main body having liquid flow paths, and an aperture surface having flow path openings communicated with the flow paths; providing a discharge port plate having extrusions each on the circumference of an inside opening communicated with each of the discharge ports, being on the inner face on the side opposite to the discharge port surface provided with discharge ports for discharging liquid, and a base having a substantially flat surface. For this method, the discharge port plate is arranged in a state of these surfaces formed integrally to be in contact; bonding the aperture surface and the inner face to fit the extrusions into the flow path openings by pressing the head main body and the base in the direction of the head main body and the base approaching each other with the discharge port plate between them; and separating the base from other members. With the method of manufacture thus structure, the liquid discharge head presents an excellent discharge efficiency by the provision of the extrusions that enter the flow paths from the orifice plate. It also becomes possible to manufacture a highly reliable liquid discharge head by a simpler manufacturing apparatus in a shorter period of time at lower costs.

55 Claims, 27 Drawing Sheets

U.S. PATENT DOCUMENTS

| | | | | |
|---|---|---|---|---|
| 4,450,455 | A | 5/1984 | Sugitani et al. | 346/140 R |
| 4,521,787 | A | 6/1985 | Yokota et al. | 346/140 R |
| 4,558,333 | A | 12/1985 | Sugitani et al. | 346/140 R |
| 4,568,953 | A | 2/1986 | Aoki et al. | 346/140 R |
| 4,666,823 | A | 5/1987 | Yokota et al. | 430/320 |
| 5,059,973 | A | 10/1991 | Watanabe | 346/1.1 |
| 5,148,193 | A | 9/1992 | Inamoto et al. | 346/1.1 |
| 5,208,604 | A | 5/1993 | Watanabe et al. | 346/1.1 |
| 5,548,894 | A | 8/1996 | Muto | 29/890.1 |
| 5,604,521 | A | 2/1997 | Merkel et al. | 347/47 |
| 5,653,901 | A | 8/1997 | Yoshimura | 219/121.71 |
| 5,786,832 | A | 7/1998 | Yamanaka et al. | 347/45 |
| 5,940,957 | A | 8/1999 | Goto et al. | 29/611 |
| 5,992,981 | A | 11/1999 | Sugitani et al. | 347/63 |

FOREIGN PATENT DOCUMENTS

| | | | | |
|---|---|---|---|---|
| EP | 0 819 536 | | | 2/1998 |
| JP | 6-91876 | | | 4/1994 |
| JP | 10-138472 | A | * | 5/1998 |
| JP | 11-129485 | A | * | 5/1999 |
| JP | 11-157086 | A | * | 6/1999 |
| WO | WO96/083775 | | | 3/1996 |

* cited by examiner

LIQUID DISCHARGE HEAD, METHOD OF MANUFACTURE THEREFOR AND LIQUID DISCHARGE RECORDING APPARATUS

BACKGROUND OF THE INVENTION

1. Field of the Invention

The present invention relates to a liquid discharge head for recording by discharging liquid as flying droplets which adhere to a recording medium, and a method of manufacture therefor. The invention also relates to a liquid discharge recording apparatus.

The present invention relates to a liquid discharge head, a method of manufacture therefor, and a liquid discharge apparatus applicable to a printer that records on a recording medium, such as papers, threads, textiles, cloths, leathers, metals, plastics, glass, wood, ceramics, and also, applicable to a copying machine, a facsimile equipment provided with communication system, and a word processor provided with the printing unit, among some others. Further, the invention also relates to those applicable to recording systems for industrial use which are structured by the complex combination of various kinds of processing apparatuses. Here, the term "recording" referred to in the specification hereof means not only the provision of meaningful images, such as characters, graphics, but also, it means the provision of such meaningless images as patterns recorded on a recording medium.

2. Related Background Art

Conventionally, there has been known an ink jet recording apparatus that records by discharging ink serving as recording liquid form the orifices formed for the liquid discharge head as an excellent recording apparatus in that it is capable of recording at high speeds in a lesser amount of noises. Along with the advances of printing technologies in recent years, the ink jet recording apparatus is required to be able to record in higher speeds in higher precision. As a result, the size of the discharge ports (the orifice diameter) becomes finer, and at the same time, the discharge ports are formed in higher density.

FIG. 1A is a perspective view which schematically shows one example of the liquid discharge head used of the conventional ink jet recording apparatus. FIG. 1B is a cross-sectional view thereof, taken in the flow path direction.

As shown in FIGS. 1A and 1B, the head comprises an orifice plate 102 having a plurality of orifices 101 for discharging ink, and the head unit 110 which is bonded to the orifice plate 102 by use of bonding agent 106 in order to supply ink to be discharged from the orifices 101. The head unit 110 is provided with the flow paths 112 communicated with the orifices 101 to supply ink to be discharged from the orifices 101; the ceiling plate 111 which forms the flow paths 112; and the energy generating elements 114 that generate energy for discharging from the orifices 101 the which ink supplied from the flow paths 112. Then, the unit comprises the substrate 113 that forms the flow paths 112 together with the ceiling plate 111.

Here, for the orifice plate 102, fine orifices 101 are arranged in order to discharge ink. Since the orifices 101 present an important factor of which the discharge performance of the liquid discharge head is dependent, it is required for the orifices to provide an excellent machinability, and resistance to ink, because the orifices are directly in contact with ink.

Conventionally, as the material of the orifice plate that satisfies such an operational condition as described above, there is a metallic plate, such as SUS, NI, Cr, Al or a resin film material, such as polyimide, polysulfone, polyethersulfone, polyphenylene sulfide, polypropylene, polyether etherketon, among some others. If a metallic plate is used for the orifice plate, it is generally practiced to use a method, such as electrocasting, for the formation of the orifices. If a resin film is used for the material of the orifice plate, it is generally practiced to use a method for forming the orifices by processing the resin film finely by means of the excimer laser ablation.

However, when the orifice plate is bonded to the head main body, it is extremely difficult to connect the fine discharge ports with the flow paths without any gaps, which should be communicated with the discharge ports. Particularly when the orifice plate formed by the resin film should be bonded to the head main body, the orifice plate may often be fixed in a deflected condition due to the flexibility of the orifice plate. in this case, the direction of the plural discharge ports formed for the orifice plate is allowed to be varied eventually. The products thus manufactures should be refused. Also, if the water repellent layer should be provided for the surface of the filmed resin, there is a fear that the water repellent layer is subjected to damages when the resin is handled. As a result, an utmost care should be exercised for handling when the bonding operation is carried out for the orifice plate.

Further, for the color image formation which has rapidly been in more demand, particularly for the formation of photographic color images, it is required to place the ultrafine ink droplets exactly in higher density on the desired positions on a recording medium. Therefore, it is extremely important to maintain the exact positional relationship between the four-color head units, yellow, cyan, magenta, and black, for example.

FIG. 2 is a perspective view which schematically shows one structural example of the liquid discharge head used for the conventional ink jet recording apparatus which is capable of forming color images. As shown in FIG. 2, the conventional ink jet recording apparatus capable of forming color images is provided with the liquid discharge head having the orifice plates 202*a* to 202*d* and the head units 210*a* to 210*d* for each of the plural colors. Then, the head units 210*a* to 210*d* are arranged on the predetermined positions of the frame 230, respectively.

Here, as a technique to enhance the positional precision between the head units 210*a* to 210*d* with each other, a method or the like is adopted to connect and bond the head units 210*a* to 210*d* with the frame 230 corresponding to each color in such a manner that each position of discharge ports of the head units 210*a* to 210*d* for the respective colors is recognized in advance by the application of image processing, and then, each position of the discharge ports thus recognized is offset from the positioning standard set on the frame 230 for the printer main body.

Now, hereunder, the description will be made of the method for manufacturing the liquid discharge head described above. At first, the flow path walls and the electrothermal transducing elements serving as discharge energy generating elements are arranged on the silicon substrate. Then, the ceiling plate formed also by a silicon substrate, for example, is bonded with this substrate. After that, by use of the diamond blade for adjusting the positions of the flow paths and the like, the head units are cut per color. Then, each of the orifice plates is bonded to the head unit thus cut by use of a bonding agent, such as epoxy resin.

Subsequently, the position of the head unit bonded to the orifice plate is recognized by means of the image processing, thus connecting and bonding it with the frame after adding the offset value with respect to the positioning standard set in advance for the frame. In this manner, the positioning relationship between four head units is determined relatively.

However, with respect to a liquid discharge head manufactured by the conventional method of manufacture as described above, there is a problem which may make it difficult to maintain the placement accuracy for the ink jet recording apparatus which should be provided with a resolution of as high as 1200 dpi to 1440 dpi or even as high as 2400 dpi as to the relative relationship between the head units for each color in recent years. If, for example, the liquid discharge head of four-color structure should be manufactured, there is a need for controlling six axes, that is, X, Y, Z, θx, θy, and $\mu$z, for the relative positions between the head units for each color as shown in FIG. 1A.

In accordance with the conventional method of manufacture, however, the positioning is carried out on the basis of the discharge ports as having been observed. Therefore, although the X, Y, and θz axes can be aligned in high precision, the positioning accuracy of the remaining axes, Z, θx, and θy, becomes dependent of the adjustment precision of the jig used for the assembling device eventually. Particularly for the θy axis, a greater placement deviation may take place on a recording medium if any minute deviation occurs due to the adjustment accuracy of the jig for the assembling device.

Also, as to the Z axis, minute deviations are allowed to occur between each of the head units. As a result, difference may take place in the advancing amount of the rubber blade that wipes stains and overly viscose ink on the orifice plate or in the capping which is needed for preventing ink from being dried, thus creating gaps eventually. Further, each of the head units is clamped to be set on the frame individually. As shown in FIG. 2, therefore, there is a need for securing a gap between each of the head units so that the jig clamp can be placed between them, and a problem is encountered that the four-color integrated liquid discharge head is made greater inevitably.

SUMMARY OF THE INVENTION

It is an object of the present invention to provide a liquid discharge head presenting an excellent operativity without any fear that the head performance is degraded when the orifice plate having discharge ports formed therefor is bonded to a head main body having flow paths provided therefor, as well as to provide a method of manufacture therefor, and a liquid discharge apparatus.

It is another object of the invention to provide a liquid discharge head capable of setting the relative positions between discharge ports for plural colors in high precision, at the same time, being capable of enhancing the precision of wiping and capping thereof, as well as to provide the method of manufacture therefor, and a liquid discharge apparatus.

It is still another object of the invention to provide a liquid discharge head capable of implementing the miniaturization thereof in higher quality at lower costs, and also, the enhancement of productivity and reliability, as well as to provide the method of manufacture therefor, and a liquid discharge apparatus.

It is a further object of the invention to provide a liquid discharge head having good discharge efficiency with the extrusions that enter the flow paths from the orifice plate, which can be easily manufactured by a simple manufacturing apparatus in a shorter period of time, as well as to provide the method of manufacture therefor, and a liquid discharge apparatus.

It is still a further object of the invention to provide a liquid discharge head capable of recording high quality images even for the arrangement of discharge ports which should be further in progress so as to require a higher density thereof, as well as to provide the method of manufacture therefor, and a liquid discharge apparatus.

It is still another object of the invention to provided a method for manufacturing a liquid discharge head which comprises the steps of providing a head main body having liquid flow paths, and an aperture surface having flow path openings communicated with the flow paths; providing a discharge port plate having extrusions each on the circumference of an inside opening communicated with each of the discharge ports, being on the inner face on the side opposite to the discharge port surface provided with discharge ports for discharging liquid, and a base having a joint surface in contact with said discharge port, the discharge port plate being arranged in a state of said discharge port surface and said joint surface formed integrally to be in contact; bonding the aperture surface and the inner face to fit the extrusions into the flow path openings by pressing the head main body and the base in the direction of the head main body and the base approaching each other with the discharge port plate between them; and separating the base from other members.

It is still another object of the invention to provide a method for manufacturing a liquid discharge head comprising the steps of providing a member for structuring a head main body having grooves becoming liquid flow paths, and an aperture surface having edge openings of the grooves; providing a discharge port plate having extrusions each on the circumference of an inside opening communicated with each of the discharge ports, being on the inner face on the side opposite to the discharge port surface provided with discharge ports for discharging liquid; bonding the aperture surface and the inner face to fit the extrusions into the edge openings by enabling the member for structuring the head main body and the discharge pot plate to approach each other; and forming the liquid flow paths by bonding the member for structuring the head main body with a plate member for closing the grooves.

It is still another object of the invention to provide a method for manufacturing a liquid discharge head comprising the steps of providing a member for structuring a head main body having grooves becoming liquid flow paths, and an aperture surface having edge openings of the grooves; providing a discharge port plate having inside openings each communicated with each of the discharge ports, being on the inner face on the side opposite to the discharge port surface provided with discharge ports for discharging liquid; bonding the aperture surface and the inner face to communicate the discharge ports with the edge openings by enabling the member for structuring the head main body and the discharge pot plate to approach each other; and forming the liquid flow paths by bonding the member for structuring the head main body with a plate member for closing the grooves.

It is still another object of the invention to provide a method for manufacturing a liquid discharge head comprising the steps of providing a member for structuring a head main body having grooves becoming liquid flow paths, and an aperture surface having edge openings of the grooves; providing a discharge port plate having recessed portions on the inner face on the side opposite to the discharge port surface provided with discharge ports for discharging liquid; bonding the aperture surface and the inner face to communicate the discharge ports with the edge openings by enabling the member for structuring the head main body and the discharge pot plate to approach each other; and forming the liquid flow paths by bonding the member for structuring the head main body with the plate member by enabling the plate member for closing the grooves to abut against the inner face of the recessed portions.

It is still another object of the invention to provide a method for manufacturing a liquid discharge head comprising the steps of providing a member for structuring a head main body having grooves becoming liquid flow paths, and an aperture surface having edge openings of the grooves; providing a discharge port plate having extrusions each on the circumference of an inside opening communicated with each of the discharge ports, being on the inner face on the side opposite to the discharge port surface provided with discharge ports for discharging liquid, and a base having a joint surface in contact with said discharge port surface in an integrated state of the discharge port surface and the joint surface being in contact; bonding the aperture surface and the inner face to fit the extrusions into the edge openings by pressing the member for structuring a head main body and the base in the direction of the member for structuring a head main body and the base to approach each other with the discharge plate between them; forming the liquid flow paths by bonding the member for structuring the head main body with a plate member for closing the grooves; and separating the base from other members.

It is still another object of the invention to provide a liquid discharge head which comprises a plurality of head main bodies having liquid flow paths, and an aperture surface provided with flow path openings communicated with the flow paths; a discharge port plate having extrusions each arranged on the circumference of inner openings communicated with the discharge ports, being on the inner face on the side opposite to the discharge port surface having discharge ports for discharging liquid, the plurality of head main bodies being arranged and bonded to the discharge port plate shared by them, and each of the aperture surface and inner faces of the plurality of head main bodies being bonded to fit the extrusions into the flow path openings.

It is still another object of the invention to provide a liquid discharge head which comprises a head main body having liquid flow paths, and an aperture surface provided with flow path openings communicated with the flow paths; a discharge port plate having extrusions each arranged on the circumference of inner openings communicated with the discharge ports, and grooves arranged on the circumference of the extrusions, being on the inner face on the opposite to the discharge port surface provided with discharge ports for discharging liquid. For this liquid discharge head, the aperture surface and the inner face are bonded to fit the extrusions into the flow path openings.

It is still another object of the invention to provide a liquid discharge head which comprises a member for structuring a head main body having an aperture surface provided with grooves becoming liquid flow paths, and an aperture surface provided with the edge openings of the grooves; a plate member for covering the grooves by being bonded to the member for structuring a head main body; a discharge port plate having recessed portions arranged on the inner face on the side opposite to the discharge port surface provided with discharge ports for discharging liquid. For this liquid discharge head, the aperture surface and the inner face are bonded to communicate the discharge ports with the edge openings, and the plate member is allowed to enter the recessed portions to be bonded with the member for structuring a head main body for the formation of the flow paths.

It is still another object of the invention to provide a method for manufacturing a discharge port plate used for a liquid discharge head comprising the steps of forming on an elongated resin film the recessed portions for the formation of a plurality of discharge ports; arranging a laminate layer on the surface of the resin film having no recessed portions for the formation of the plurality of discharge ports; forming discharge ports for the recessed portions on the resin film for the formation of the plurality of discharge ports; bonding the resin film to the head main body; and removing the laminate layer.

In accordance with the present invention, the laminate layer is laminated on the surface of the orifice plate. Therefore, the surface of the orifice plate follows the flat plane of the laminate layer, hence making it possible to bond the orifice plate with the head main body in an excellent flatness. With the bonding method which provides the extrusions for the orifice plate in the positions of the flow path apertures of the head main body, in particular, it becomes possible for the extrusions on the orifice plate side to enter the flow paths on the head main body side. Then, when being bonded, there is no possibility that the extrusions and the discharge ports are deformed or damaged. Also, the water repellent layer on the surface of the orifice plate is protected by the laminate layer, thus eliminating a fear that the water repellent layer is damaged.

Also, the thickness of the laminate layer is made sufficiently larger than that of the orifice plate film when the laminate layer is formed with resin film. The robustness of the laminate layer becomes greater. As a result, when being bonded, the surface of the orifice plate can follow the laminate layer to maintain the flatness of the orifice plate in good condition. Also, if the laminate layer is formed by stainless steel, this layer can acquire robustness greater than the resin. Therefore, at the time of being bonded under pressure, the face plane of the orifice plate can be maintained flatly in a better condition.

For one orifice plate, a plurality of discharge port arrays are arranged at a time or sequentially corresponding to a plurality of flow paths arranged for a plurality of head units, respectively. Then, on the discharge port side of the orifice plate, a robust jig is arranged to hold the orifice plate horizontally. The head unit clamped by the jig which has been adjustably set vertically to the surface of the jig that holds the orifice plate is bonded to the surface of the head unit where the orifice plate is bonded. Lastly, with the orifice plate serving as reference, each adjustment axis of the head unit is made to follow it, hence determining the relative positions between a plurality of head units. As a result, it becomes possible to implement the manufacture of a highly precise color liquid discharge head without a higher production technologies and techniques.

Further, in accordance with the present invention, the discharge efficiency of liquid is enhanced, because of the presence of the extrusions that enter the flow paths, and at the same time, the working efficiency becomes excellent, because the extrusions are formed together with the discharge ports simultaneously. Particularly, with the formation of the extrusion and discharge ports by the irradiation of laser beams, the operation becomes simpler. In this case, the laser beams are irradiated with the mask, while changing the transmissivities thereof locally. Then, the formation is made in good precision. Here, therefore, in accordance with the present invention, it becomes possible to shorten the time required for processing to manufacture a liquid discharge head having an excellent discharge efficiency, hence implementing the enhancement of the productivity thereof.

Also, there is no need for any positioning that may be performed excessively when executing each process. The manufacture becomes easier, while it becomes possible to simplify the manufacturing apparatus.

Also, with the grooves formed on the circumference of the extrusions, it becomes possible to prevent the bonding agent used for bonding the orifice plate from flowing into the flow paths and discharge ports as well. Here, it enhances the operational efficiency if these grooves are also formed with extrusions and discharge ports at a time.

In addition, if it is arranged to bond the orifice plate and the substrate or the ceiling plate at first, and then, to bond the ceiling plate or the substrate to this bonded body, the bonded edges of the substrate and the ceiling plate is aligned with the orifice plate surface. Therefore, the manufacture of the head becomes simpler and more efficient. Particularly, if a cut-out portion is arranged for the orifice plate to receive at least a part of the ceiling plate or the substrate or if the extrusions are arranged for a part of the orifice plate to enter the flow path, it becomes possible to manufacture the head simpler in precision higher still.

Also, the end portion of each flow path is cut without requiring any grinding. Then, there is no possibility that the nozzle walls are chipped off or broken in the vicinity of each discharge port even if the nozzle pitches become highly densified. As a result, it is possible to discharge desired recording droplets in good condition.

BRIEF DESCRIPTION OF THE DRAWINGS

FIG. 1A is a schematically perspective view; FIG. 1B is a cross-sectional view taken in the flow path direction.

FIG. 14A is a view illustrating the step in which the head units are positioned to the orifice plate; and FIG. 14B is a view illustrating the step in which the frame is bonded to the orifice plate.

DETAILED DESCRIPTION OF THE PREFERRED EMBODIMENTS

Hereinafter, with reference to the accompanying drawings, the description will be made of the embodiments in accordance with the present invention.

Figure 1A:
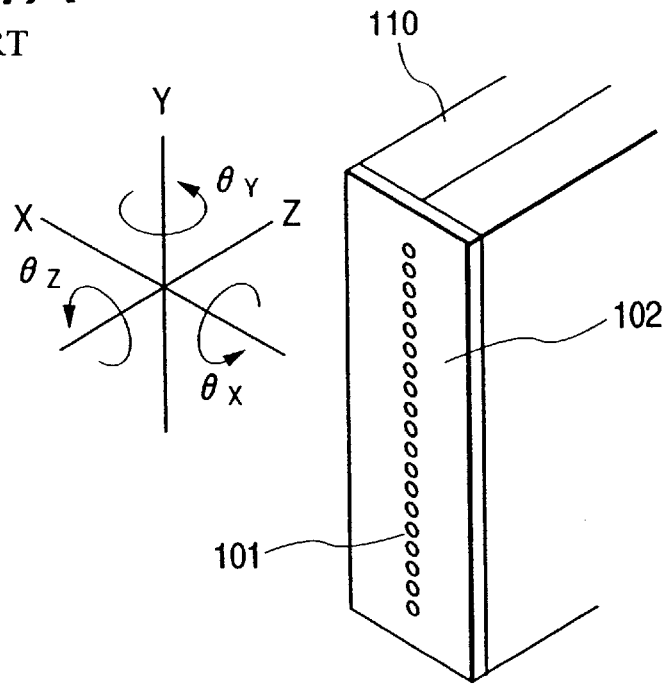
FIG. 1A PRIOR ART
FIGS. 1A and 1B are views which illustrate one structural example of a liquid discharge head used for the conventional ink jet recording apparatus.
Figure 1B:
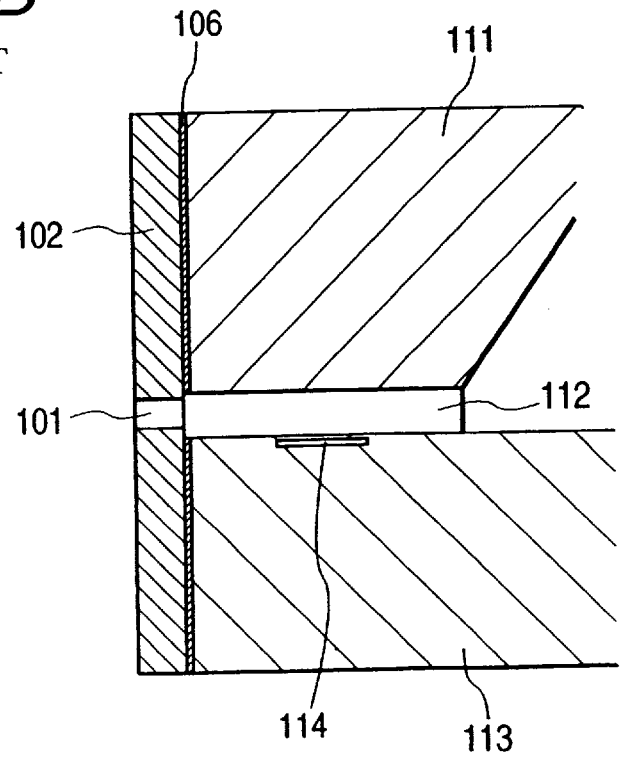
FIG. 1B PRIOR ART
Figure 2:
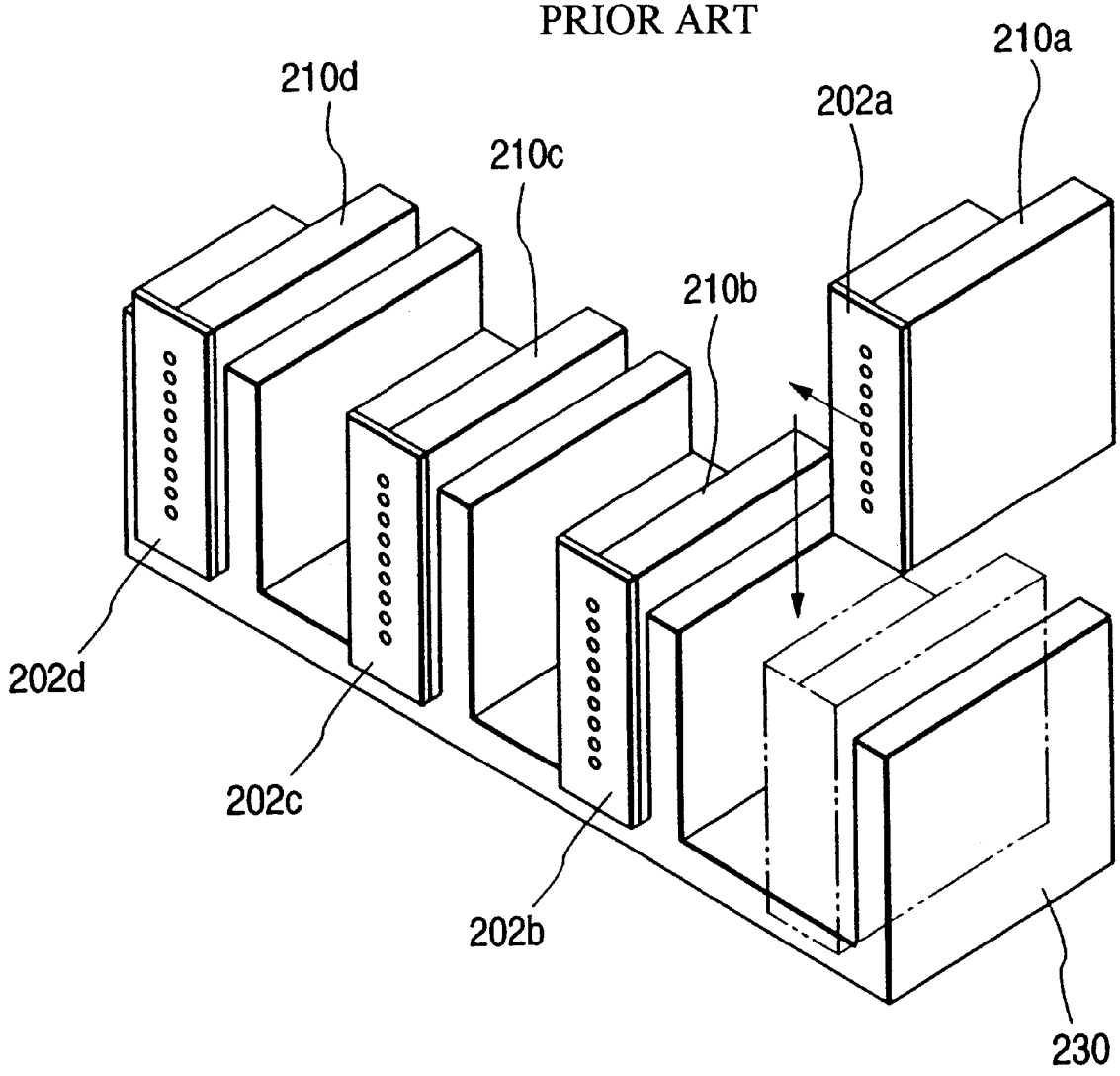
FIG. 2 PRIOR ART
FIG. 2 is a perspective view which schematically shows one structural example of a liquid discharge head used for the conventional ink jet recording apparatus capable of forming color images.
Figure 3:
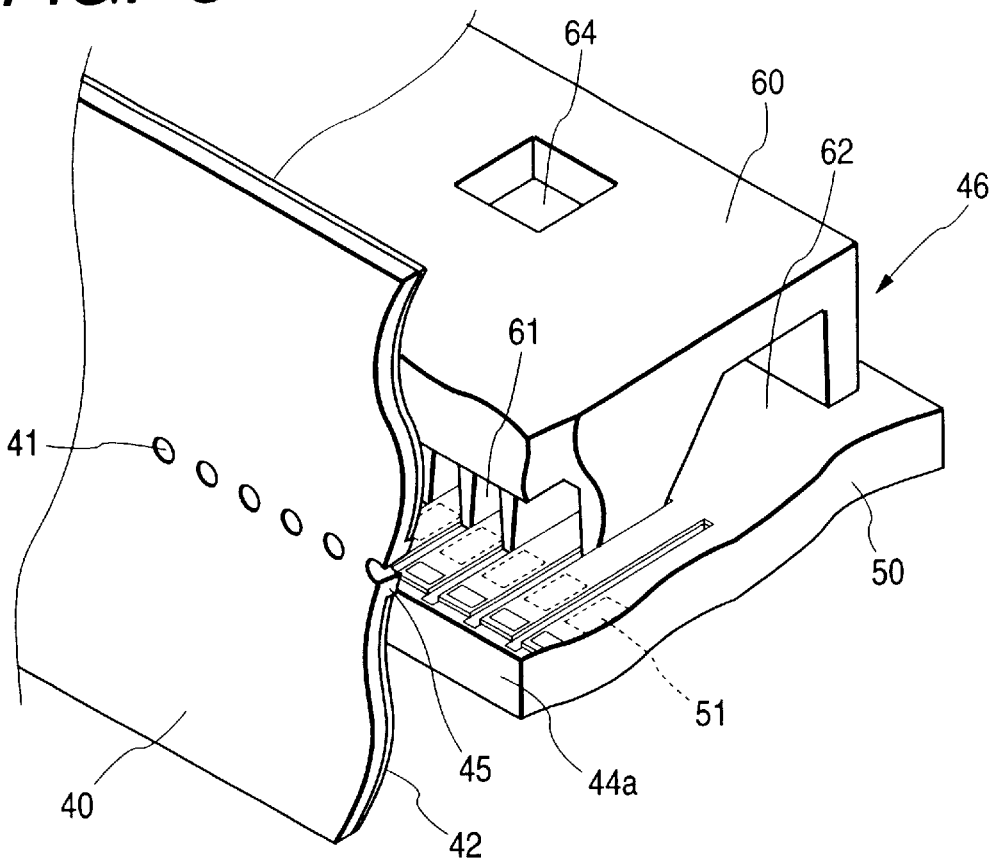
FIG. 3 is a perspective view which illustrates the liquid discharge head to which the method for manufacturing a liquid discharge head is applicable in accordance with one embodiment of the present invention.
Figure 4:
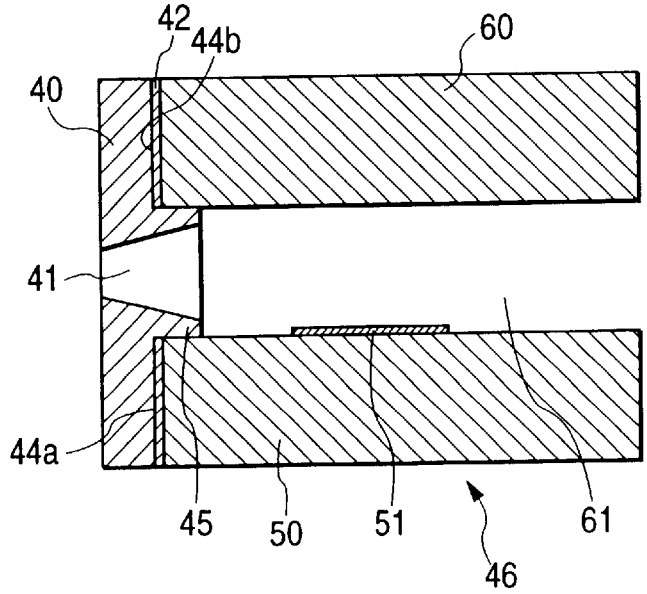
FIG. 4 is a cross-sectional view which shows the liquid discharge head represented in FIG. 3, taken in the flow path direction.

FIG. 3 is a perspective view which illustrates the liquid discharge head to which the method for manufacturing a liquid discharge head is applicable in accordance with one embodiment of the present invention. FIG. 4 is a cross-sectional view which shows the liquid discharge head represented in FIG. 3, taken in the flow path direction.

As shown in FIG. 3, the liquid discharge head, which manufactured by the method for manufacturing a liquid discharge head in accordance with the present embodiment, comprises the head main body 46 formed by bonding the ceiling plate 60 to the surface of the substrate 50, and the orifice plate 40 bonded to the front face of the head main body 46, among some others.

Now, the substrate (hereinafter, may be referred to as a "heater board") 50 is provided with a plurality of energy generating elements (hereinafter, may be referred to as "heaters") 51 which generate thermal energy utilized for discharging ink or some other liquid, and also, with the Al wiring for supplying electric signals to the energy generating elements 51. The substrate 50 is formed with a plurality of energy generating elements 51 and the Al wiring on the Si substrate by the application of the film formation technologies and techniques.

On one face of the ceiling plate 60, there are provided the grooves to form a plurality of flow paths 61 having the energy generating elements 51 arranged therefor, respectively; and the groove for the formation of the liquid chamber 62 to retain ink provisionally before being supplied to each of the flow paths 61. Further, for the ceiling plate 60, the supply port 64 is formed to supply ink to the liquid chamber 62. The substrate 50 and the ceiling plate 60 are bonded so as to arrange each of the energy generating elements 51 for each of the flow paths 61. In this manner, the head main body 46 is structured with the provision of the plural flow paths 61 and the plural energy generating elements 51. On the front face of the head main body 46, that is, the face including the bonded surface 44*a* of the substrate 50 with the orifice plate 40 and the bonded surface 44*b* of the ceiling plate 60 with the orifice plate 40, each opening of the flow paths 61 is arranged as shown in FIG. 4.

On the other hand, a plurality of discharge ports (hereinafter, may be referred to as "orifices") 41, which are respectively communicated with the flow paths 61, are arranged on the orifice plate 40. Also, on the circumference of the discharge ports 41 on the bonded surface of the orifice plate 40 with the head main body 46, each of the plural extrusions 45 is formed individually per discharge port 41.

Each of the extrusions 45 advances into each of the flow paths 61. Then, in the state where the extrusion 45 is positioned in the flow path 61, the orifice plate 40 is bonded to the bonding surface 44*a* and 44*b* by use of the bonding resin 42 which is the bonding agent.

In the liquid discharge head thus manufactured, the thermal energy generated by means of each energy generating element 51 act upon ink in each of the flow paths 61 to create bubbles on each of the energy generating elements 51. Then, by the utilization of the creation of such bubbles, ink is discharged from each of the discharge ports 41.

Figure 5:
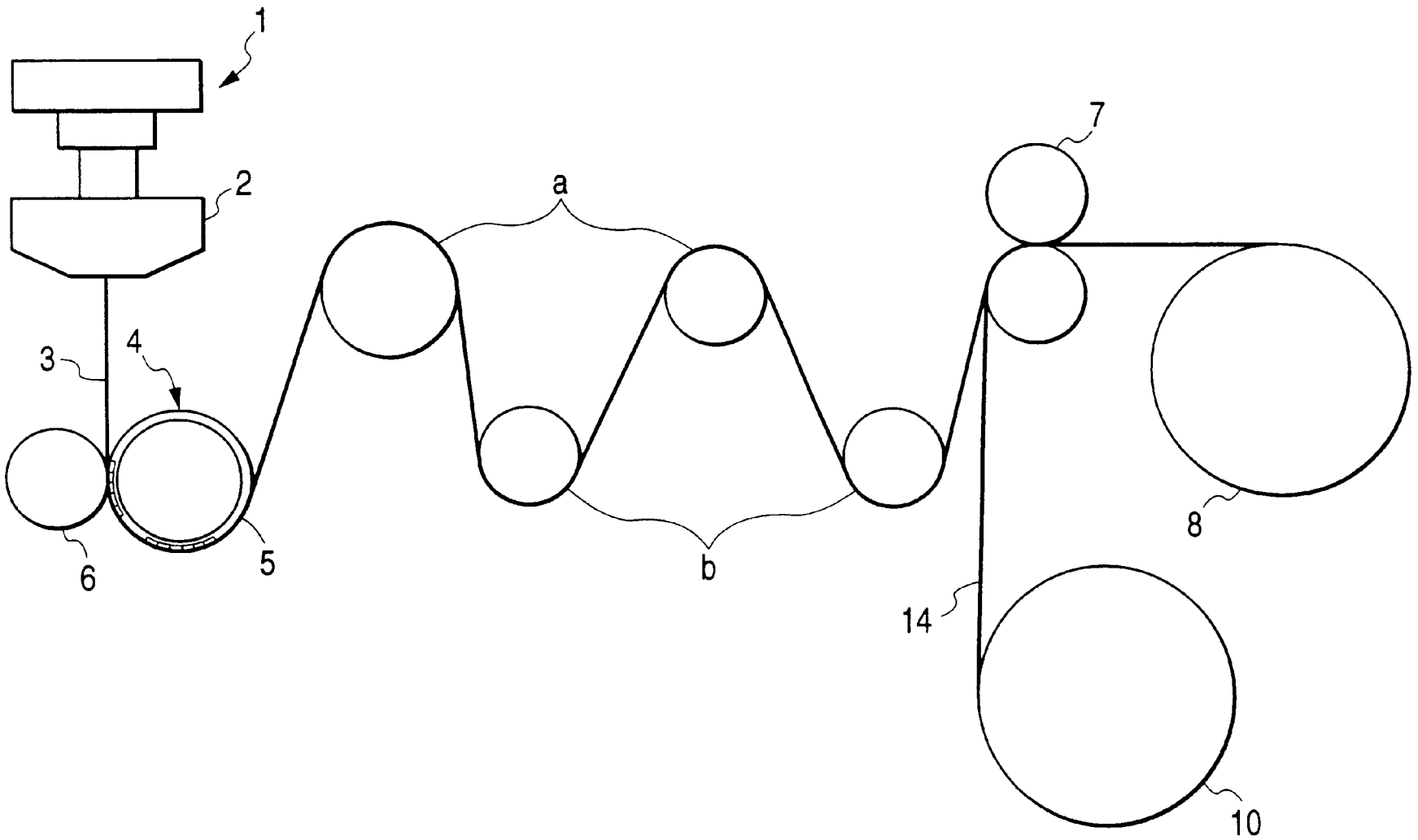
FIG. 5 is a view which schematically shows a part of the manufacturing line used for the method for manufacturing a liquid discharge head in accordance with one embodiment of the present invention.

FIG. 5 is a view which schematically shows a part of the manufacturing line used for the method for manufacturing a liquid discharge head in accordance with one embodiment of the present invention. The manufacturing line shown in FIG. 5 is the one that manufactures the orifice plate 40 illustrated in FIG. 3 and FIG. 4. In accordance with this manufacturing line, the molten resin is extruded from an extruder in the form of film. Then, the roller, which is provided with a relief die of a specific configuration, is pressed on the surface of the film resin thus extruded to form a desired pattern on the surface of the film resin. In this step, the process is performed up to the formation of the desired pattern on the surface thereof.

As shown in FIG. 5, the film resin 3 is formed by extruding the molten resin from the die 2 of the extruder 1 in the form of film. The film resin 3 is nipped between the cooling roller 5 and the nip roller 6 to be pressed by these rollers. On the surface of the cooling roller 5, the relief die 4 is attached in the configuration corresponding to the shapes of the discharge ports 41 and the extrusions 45 shown in FIG. 3 and FIG. 4. With the relief type 4 thus arranged, a desired configuration is continuously formed on the surface of the film resin 3.

The film resin 3 cooled by the cooling roller 5, while having a desired configuration on the surface thereof by use of the relief die 4, is carried by means of some numbers of the carrier rollers a and b, and then, laminated with the laminating layer (which may be referred to as a "base") 14, which is being wound out from a roller 10. After that, the film resin is wound around the winding roller 8 in the rolled form through two drawing rollers 7. Here, the film resin 3 is wound so that the extrusions 45 are placed on the outer side of the winging roller 8. In this respect, it is more preferable to make the curvature radius of the winding roller 8 larger.

For the method of manufacturing a liquid discharge head of the present embodiment, polysulfone resin (the "Udel P3900 manufactured by Amoco Inc.) is used as the resin material which is extruded from the extruder 1. It is preferable to use thermoplastic polymer as the resin material extruded from the extruder 1, that is, the material of the film resin 3. Also, more specifically, it is preferable to use as the material of the film resin 3 either one of polyparaphenylene telephthal amide, polyethersulfone, polyphenylene sulfide, and polyether etherketone.

Particularly, the polyparaphenylene telephthal amide (abbreviated: "PPTA") has properties, such as a lower thermal expansion coefficient (which is close to the value of the linear expansion coefficient of silicon), and a high elasticity (approximately 1500 kg/mm$^2$). While the energy generating elements of the head main body are provided for the Si substrate, if the polyparaphenylene telephthal amide is used for the orifice plate, the linear expansion coefficients of both materials become closer. As a result, there is no fear that the difference in linear expansion caused by the temperature rise or temperature fall may bring about deformation, peel off, or positional deviation between them. Also, both of them have a high elasticity that results in a high robustness, which may present an advantage that even if the orifice plate is made thinner, the flatness of its surface can be secured. If the orifice plate can be formed to be thinner, it becomes easier to form the discharge ports by the application of laser. Also, the polyparaphenylene telephthal amide has a good ablation capability when excimer laser is applied with a lower linear expansion coefficient. Therefore, at the time of laser processing, the expansion of the orifice plate can be made smaller when heated. Also, the orifice holes can be formed in good precision.

Now, the description will be made of the method for manufacturing the orifice plate 40.

At first, polysulfone resin is extruded from the die 2 under the following process condition A so as to produce the film resin 3 in a thickness of 50 $\mu$m. The film resin 3 is pressed by the cooling roller 5 provided with the relief die 4 on the surface thereof, which is at a temperature of 15° C., and the nipping roller 6 as well. Thus, the film resin 3 is pressed and cooled.

The condition A of the extruding process

Die aperture: 0.5 mm

Temperature set for the extruder:

| | |
|---|---|
| rear part | 315° C. |
| intermediate part | 360° C. |
| head and die part | 370° C. |
| Temperature set for the cooling roller: | 15° C. |

Extruded thickness: 50 $\mu$m

Nipping pressure (air gauge press): 2 kgf/cm$^2$

Figure 6A:
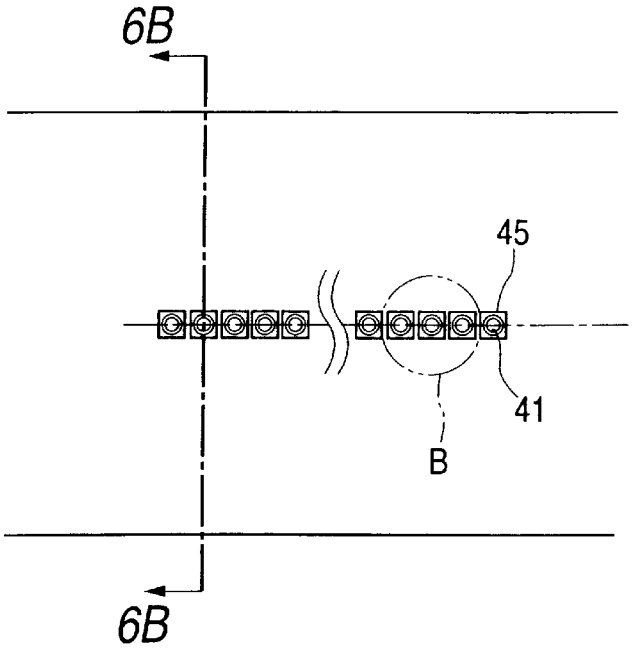
FIGS. 6A and 6B are a plan view and a cross-sectional view, respectively, which illustrate the film resin manufactured in the manufacturing line represented in FIG. 5.
Figure 6B:
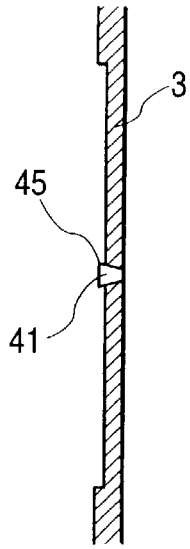
Figure 7A:
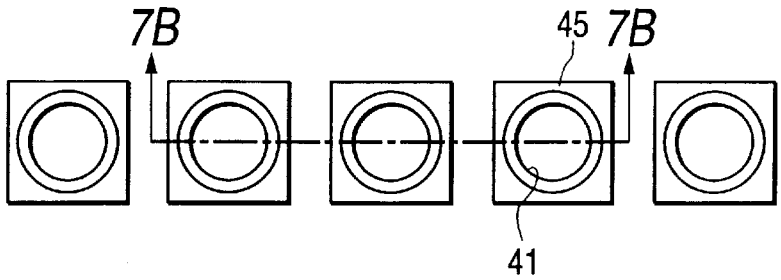
FIGS. 7A and 7B are a plan view and a cross-sectional view, respectively, which illustrate the film resin manufactured in the manufacturing line represented in FIG. 5.
Figure 7B:
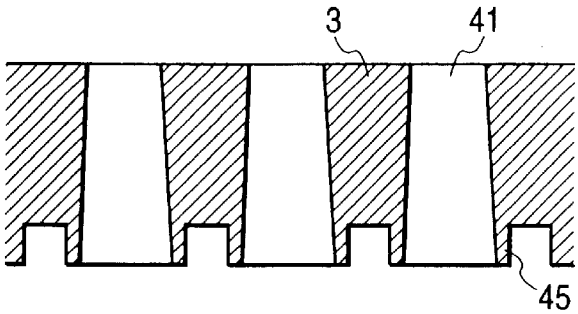

FIGS. 6A and 6B, and FIGS. 7A and 7B are a plan view and a cross-sectional view, which illustrate the film resin 3 manufactured by the manufacturing line shown in FIG. 5, respectively. FIG. 6A is a plan view which shows the film resin 3. FIG. 6B is the cross-sectional view taken along line 6B—6B in FIG. 6A. Also, FIG. 7A is the plan view showing the enlargement of the film resin at B in FIG. 6A. FIG. 7B is the cross-sectional view taken along line 7B—7B in FIG. 7A.

The relief die 4 of the cooling roller 5 is being pressed on the surface of the film resin 3. Then, with the relief die 4, a plurality of discharge ports 41 and the extrusions 45 are formed in plural sets on the film resin 3 continuously at a time in the direction in which the film resin 3 is extruded as shown in FIG. 6A, FIG. 6B, FIG. 7A and FIG. 7B.

The pitches between the extrusions 45 are the gaps equivalent to the resolution 600 dpi. The outer shape of each extrusion 45 is square column. The dimension of the outer shape of each extrusion 45 is 30 $\mu$m perpendicular ×30 $\mu$m lateral ×10 $\mu$m height. The shape of the orifice 41 is truncated cone. The diameter of the circle is 25 $\mu$m at the edge face of the orifice 41 on the extrusion 45 side. The diameter of the circle is 20 $\mu$m at the edge face opposite to the extrusion 45 side. The relief die 4 is produced so that each of the orifices 41 and extrusions 45, which is in such shape and dimension, respectively, is formed on the film resin 3 simultaneously and continuously.

After the orifices 41 and the extrusions 45 are formed by the relief die 4 on the film resin 3, the water repellent layer is formed on the surface (face plane) of the film resin 3, which is opposite to the extrusion 45 side thereof. As the water repellent treatment agent, the CTX-CZ5A, which is manufactured by the Asahi Glass Kabushiki Kaisha, is used. When the water repellent layer is formed on the face plane of the film resin 3, the face plane is made hydrophilic by means of the corona treatment at first. Then, using the microgravure coater, which is manufactured by Yasui Seiki Sha, as the coating equipment, the water repellent agent is applied to the face plane of the film resin 3. Here, the coating process of the water repellent agent, and the heating and drying processes for the water repellent agent thus applied are continuously performed so as to make the ultimate thickness of the water repellent layer 0.1 $\mu$m.

For the method of manufacture a liquid discharge head of the present embodiment, the process in which the relief die 4 is pressed to the film resin 3, and the process in which the water repellent layer is formed on the film resin 3 are carried out separately, but these two processes may be performed as one process. For example, in the process in which the relief die 4 is pressed to the film resin 3, the film resin 3 is being pressed, while the water repellent agent is supplied to the face of the film resin 3 on the nipping roller 6 side for the formation of the water repellent layer on that face or a coating roller may be set for applying the water repellent agent in the position before the film resin 3 is wound to the winding roller 8, and then, the water repellent agent is applied to the film resin 3 by use of such coating roller.

After the formation of the water repellent layer, the laminate layer 14 (see FIG. 5), which demonstrates the effect when the orifice plate is bonded as described later, is adhesively bonded (laminated) to the face plane of the film resin 3 having the water repellent layer (not shown) attached thereto.

After the discharge ports 41 and the extrusions 45 are formed as described above, the laminate layer 14 is laminated, and the film resin 3 is wound in the form of roll. The rolled film resin is cut to a required size per liquid discharge head, while smoothing it out by correcting the curling behavior thereof. In this manner, the orifice plate 40 is manufactured with the laminate layer 14 thus laminated.

Now, the description will be made of the method for manufacturing a liquid discharge head after the orifice plate 40 is manufactured with the laminate layer 14.

Subsequent to the manufacture of the orifice plate 40 with the laminate layer 14, the orifice plate 40 is bonded by use of the bonding agent to the head main body 46 which is manufactured in the process other than the one in which the orifice plate is manufactured. As the bonding agent used here, an epoxy bonding agent is adopted, because it can be hardened to the B stage (intermediate hardening condition) by the irradiation of UV (ultraviolet rays), while maintaining the tack property (viscosity) thereof, and then, the members themselves can be bonded by heating them under pressure or by further UV irradiation after the bonding agent has been hardened and shrunk. An agent of the kind may be used by the application of heat under pressure without hardening it to the B stage.

At first, the epoxy bonding agent is transferred to the contact surfaces 44*a* and 44*b* of the head main body 46 by use of the transfer method. Then, the ultraviolet rays of 1 mW/cm$^2$ is irradiated to the bonding agent thus transferred for a period of 60 seconds, hence hardening it to the B stage. In this way, while maintaining the tack property of the bonding agent, the hardening and shrinkage of the bonding agent is finished.

Figure 8A:
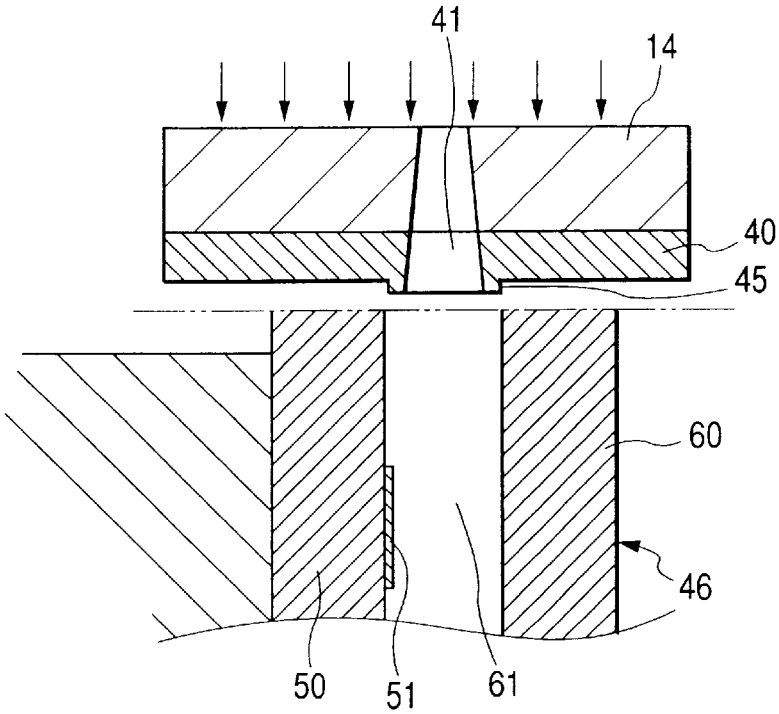
FIGS. 8A, 8B and 8C are views which schematically illustrate the state where the laminate-layered orifice plate is bonded to the head main body in the processing order of the method of manufacture in accordance with the present invention.

Then, as shown in FIG. 8A, the laminate layer 14 attached to the orifice plate 40 is held by handling to position each of the extrusions 45 at the leading end portion of each flow path 61 by allowing each of the extrusions 45, which resides on the face on the side opposite to the laminate layer 14 of the orifice plate 40, to enter each of the flow paths 61 corresponding to each of the extrusions 45. Here, clearance fit is adopted for fitting the extrusions 45 and flow paths 61.

Figure 8B:
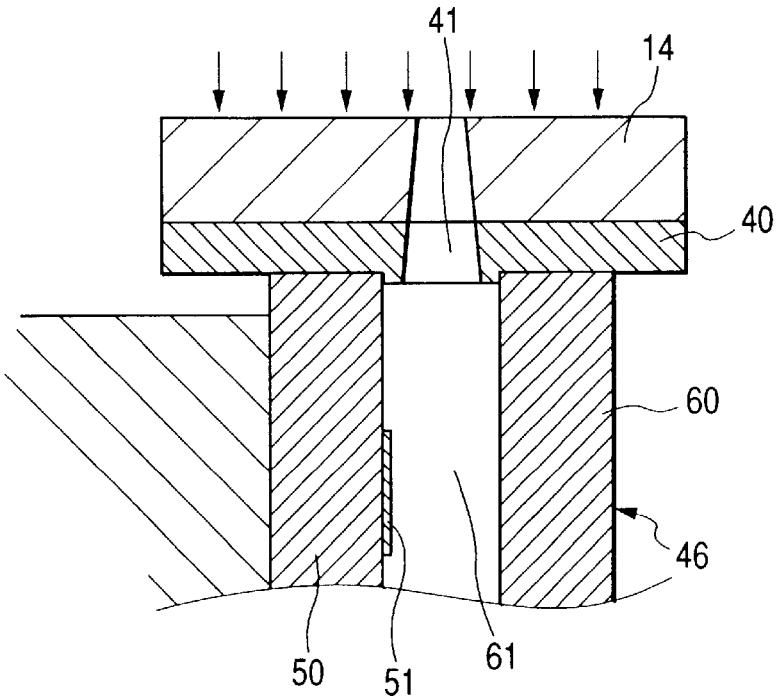

In this case, as shown in FIG. 8B, a load of 1 kg/cm$^2$ is evenly applied from the laminate layer 14 to the orifice plate 40 to enable the orifice plate 40 to be closely in contact with the head main body 46. While keeping such state, the orifice plate 40 is heated at a temperature of 60° C. and pressed to the head main body 46, hence hardening the bonding agent to complete the process. In this respect, the method is adopted so that the orifice plate 40 which has been cut in advance is bonded under pressure. However, it may be possible to cut out the orifice plate 40 at the same time that it is bonded under pressure.

Now that the laminate layer 14 is laminated on the face plane of the orifice plate 40 as described above, the face plane of the orifice plate 40 follows the flat surface of the laminate layer 14. As a result, the orifice plate 40 is bonded to the head main body 46, while keeping its flatness in good condition. In case of the present embodiment in particular, the extrusions 45 on the orifice plate 40 side can enter the flow paths 61 on the head main body 46 side, hence making it possible to prevent the extrusions 45 and the discharge ports 41 from being deformed or damaged when bonded under pressure. Also, the water repellent layer of the face plane is protected by the presence of the laminate layer 14. There is no fear that the water repellent layer is broken when bonded under pressure.

The laminate layer 14 is formed by resin material or by stainless steel. When the laminate layer is formed by resin material, the thickness of the laminate layer 14 is made sufficiently greater than that of the film of the orifice plate 40. Here, since the robustness of the laminate later 14 is greater, the face plane of the orifice plate 40 can follow the laminate layer 14 when bonded under pressure. As a result, the orifice plate 40 can be bonded with good flatness. Also, if the laminate layer 14 is formed by stainless steel, it becomes possible to provide a stronger robustness the resin material. Therefore, the flatness of the face plane of the orifice plate can be maintained in a better condition when bonded under pressure.

Figure 8C:
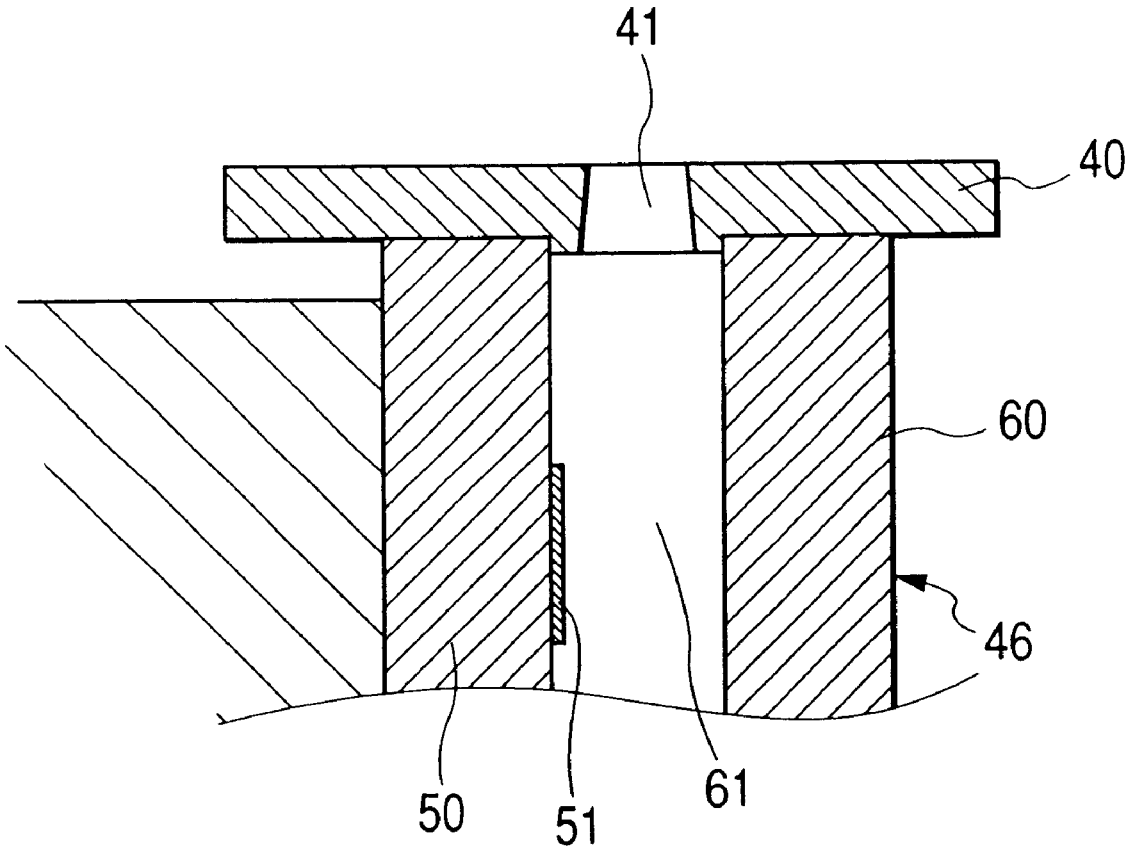

Through the processes described above, the laminate layer 14 is peeled off as shown in FIG. 8C, thus manufacturing the liquid discharge head shown in FIG. 3 and FIG. 4.

FIGS. 9A and 9B, and FIGS. 10A to 10F are views which illustrate the method for manufacturing a liquid discharge head in accordance with another embodiment of the present invention. The method of the present embodiment for manufacturing a liquid discharge head is to manufacture a liquid discharge head having the same structure and the configuration as the one manufactured by the method of manufacture in accordance with the previous embodiment, but as compared with the previous embodiment, the discharge ports are formed by means of laser processing. This is the major difference between them. Now, hereunder, the description will be made centering on the different aspects from the previous embodiment.

Figure 9B:
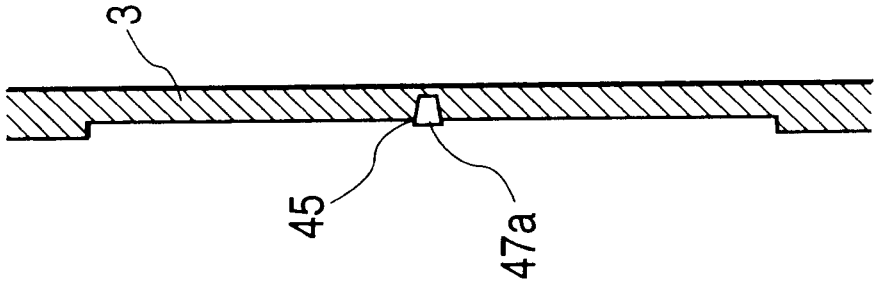
FIGS. 9A and 9B are views which illustrate the method for manufacturing a liquid discharge head in accordance with another embodiment of the present invention.
Figure 9A:
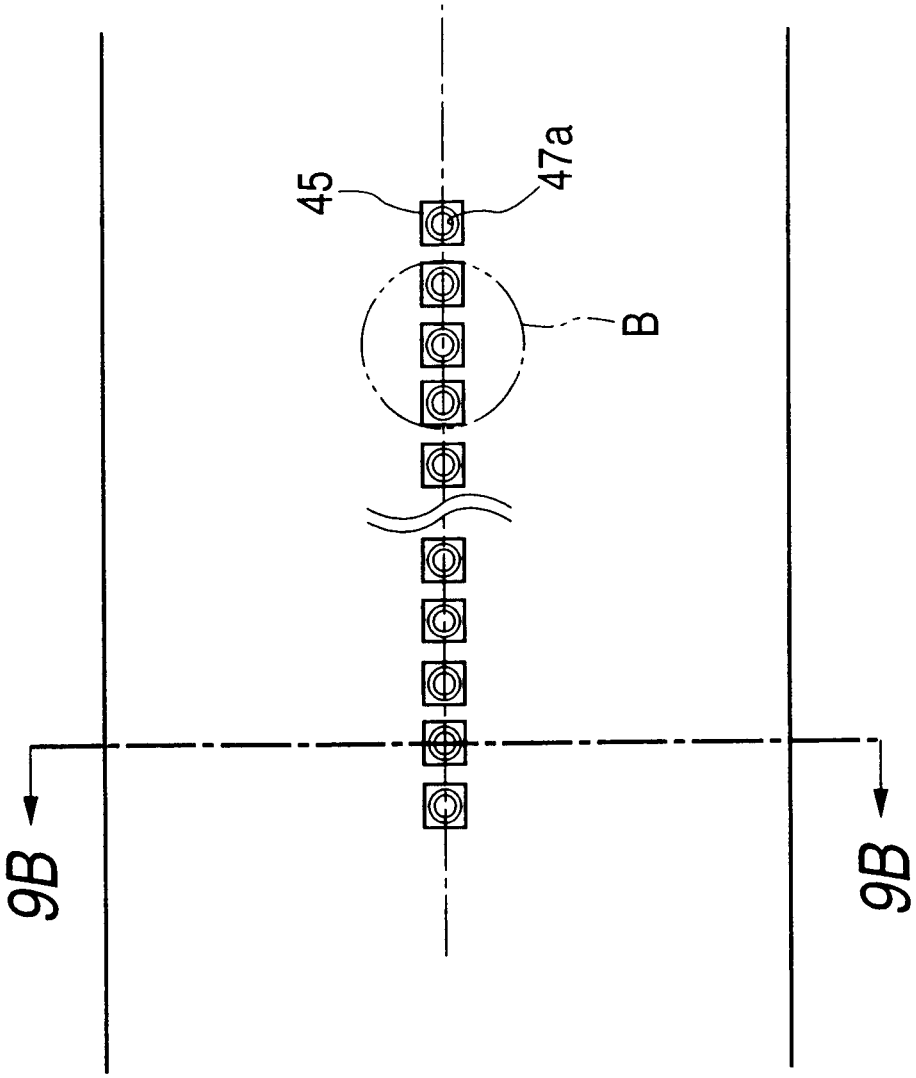
Figure 10A:
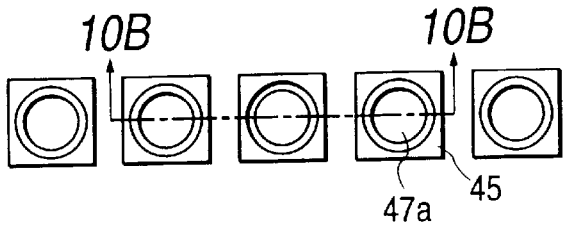
FIGS. 10A, 10B, 10C, 10D, 10E and 10F are views which illustrate the method for manufacturing a liquid discharge head in accordance with still another embodiment of the present invention.
Figure 10B:
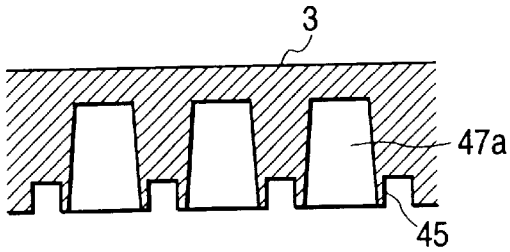

For the method of the present embodiment for manufacturing a liquid discharge head, too, the film resin used for manufacturing the orifice plate is formed by the manufacturing line shown for the previous embodiment in conjunction with FIG. 5. Here, in place of the relief die 4 used for the previous embodiment, the cooling roller 5 is used with a relief die of a specific configuration different from the relief die 4. FIG. 9A is a plan view which shows the film resin formed in the specific configuration by pressing the aforesaid relief die provided for the cooling roller 5 to the polysulfone resin being extruded from the die 2 of the extruder 1. FIG. 9B is a cross-sectional view taken along line 9B—9B in FIG. 9A. FIG. 10A is an enlarged plan view which shows the film resin at B in FIG. 9B. FIG. 10B is a cross-sectional view taken along line 10B—10B in FIG. 10A.

At first, polysulfone resin is extruded from the die 2 under the process condition A as in the previous embodiment so as to produce the film resin 3 in a thickness of 50 $\mu$m. The film resin 3 is pressed by the cooling roller 5 provided with the relief die 4 on the surface thereof, which is at a temperature of 15° C., and the nipping roller 6 as well. Thus, the film resin 3 is pressed and cooled simultaneously. In this way, by means of the relief die provided for the cooling roller 5, a plurality of extrusions 45 each individually arranged, and a plurality of recessed portions 47*a* each arranged on the central part of each extrusion 45 are formed continuously in the direction in which the film resin 3 is extruded as shown in FIG. 9A, FIG. 9B, FIG. 10A and FIG. 10B. Each of the recessed portions 47*a* is to form each of the orifices 41. The pitches between the extrusions 45 and the outer dimension of the extrusion are the same as those described in the previous embodiment. The depth of the recessed portion 47*a* is 40 $\mu$m. The relief die 4 which is provided for the cooling roller 5 is produced so that each of the extrusions 45 and recessed portions 47*a* is formed on the film resin 3 simultaneously and continuously. Then, the water repellent layer is formed on the surface (face plane) of the film resin 3, which is opposite to the extrusion 45 side thereof in the same method as applied to the previous embodiment. As the water repellent treatment agent, the CTX-CZ5A, which is manufactured by the Asahi Glass Kabushiki Kaisha, is used.

Then, on the face plane of the film resin 3 where the water repellent layer is formed, the laminate layer 14 is laminated in the same method as applied to the previous embodiment.

Figure 10C:
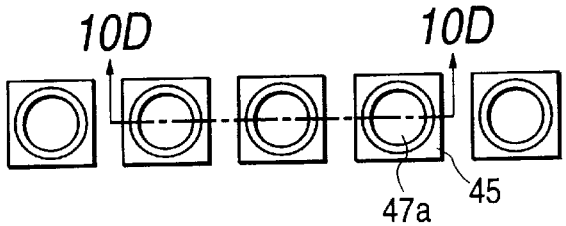
Figure 10D:
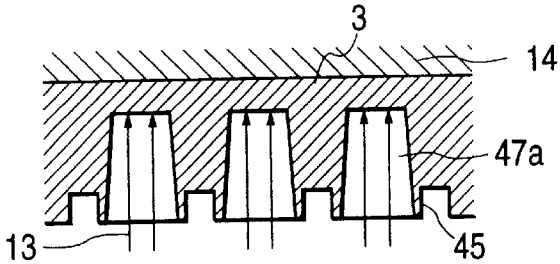

Now, with reference to FIGS. 10A to 10F, the description will be made of the manufacturing process of the orifice plate after the laminate layer 14 is laminated on the face plane of the film resin 3 having the water repellent layer formed thereon. FIG. 10C and FIG. 10D are enlarged plan views which illustrate the film resin at B in FIG. 9A. FIG. 10D is a cross-sectional view taken along line 10D—10D in FIG. 10C. FIG. 10F is a cross-sectional view taken along line 10F—10F in FIG. 10E.

Figure 10E:
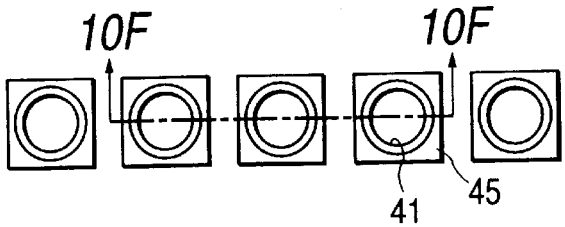
Figure 10F:
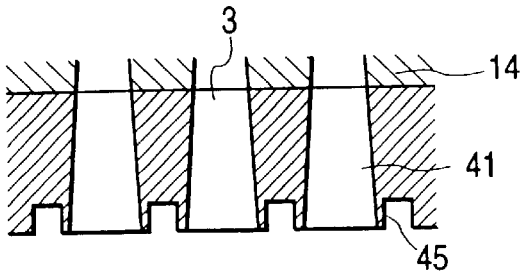

As shown in FIG. 10D, laser 13 is irradiated on each bottom face of the recessed portions 47*a* to form each of the through holes that penetrate the film resin 3 on each bottom face of the recessed portions 47*a* as shown in FIG. 10E and FIG. 10F. Here, if the laminate layer 14 is formed by resin, it is more preferable to penetrate the laminate layer 14 also by the irradiation of laser 13. In such process as described above, each orifice 41 is formed on the film resin 3 with the aperture dimension thereof is 20 $\mu$m on the side opposite to the extrusion 45 side. In this case, the laminate layer carries the adhesive particles (carbon, for instance) that may be generated at the time of laser processing of the film resin 3. Therefore, the laminate layer contributes to removing such adhesive particles, while promoting the enforcement or smoothing when bonding operation is executed.

Figure 11:
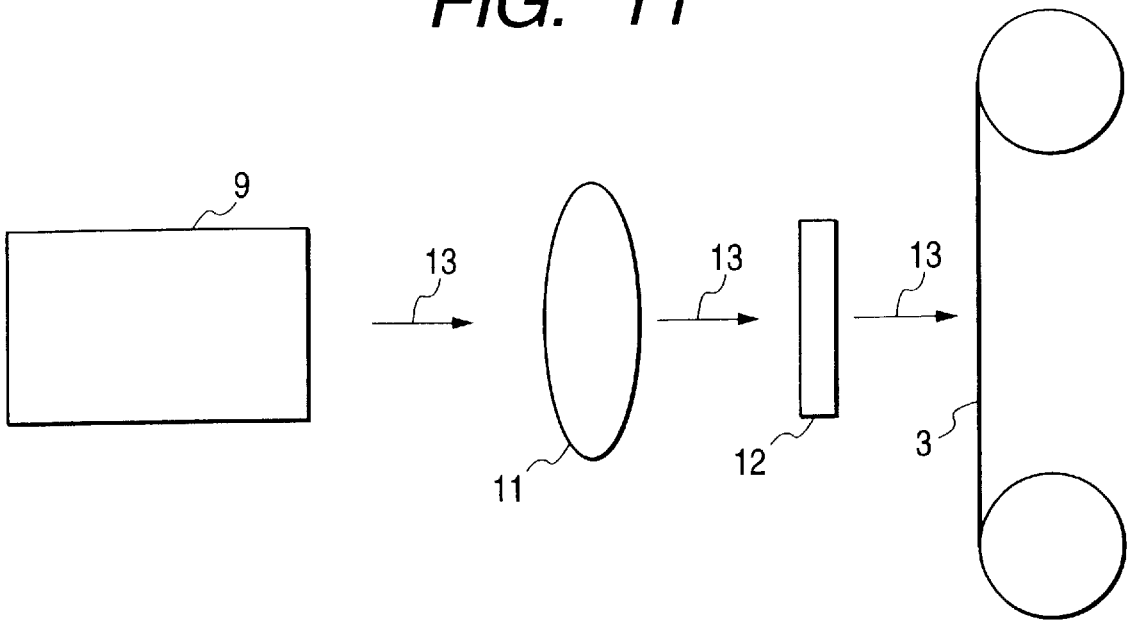
FIG. 11 is a view which schematically shows a laser processing apparatus for forming the orifices on the film resin.

FIG. 11 is a view which schematically shows the laser processing apparatus which is used for forming the orifices 41 on the film resin 3. The laser apparatus shown in FIG. 11 comprises an excimer laser oscillator 9; a condensing lens 11 that collects laser beams 13 emitted from the excimer laser oscillator 9; and a mask 12 used for irradiating the laser beams 13 on a specific portion on the film resin 3 after the condensing lens 11. The laser bemas 13 emitted from the excimer laser oscillator 9 are irradiated on the film resin 3 which is laminated with the laminate layer 14 through the condensing lens 11 and the mask 12. In other words, the film resin 3 is smoothed out after being laminated with the laminate layer 14, and then, irradiated by the laser beams 13 of the aforesaid laser processing apparatus as shown in FIG. 5.

For the present embodiment, the manufacturing line shown in FIG. 5, and the laser processing apparatus shown in FIG. 11 are separated in the description thereof. However, the laser processing apparatus shown in FIG. 11 is arranged in front of the winding roller 8 on the manufacturing line shown in FIG. 5.

Here, if the depth of each recessed portion 47*a* is made larger than the thickness of the film resin 3, while the thickness of each orifice 41, which is open by the application of laser beams 13, is made smaller within the range of the dimensional tolerance, no alignment is needed for the portion irradiated by leaser beams 13 against each of the bottom face of the recessed portions 47*a*. The laser beams 13 can be irradiated on the entire bottom face of each recessed portion 47*a*. In this way, the formation process of the orifices 41 becomes simpler, hence making it possible to reduce the manufacturing costs of the liquid discharge head, and the costs of the manufacturing apparatus as well.

As described above, the discharge ports 41 and the extrusions 45 are formed for the film resin 3, and at the same time, the laminate layer 14 is laminated. After that, it is wound around the winding roller. Then, the film resin 3 thus wound in the form of roll is cut into a required size per liquid discharge head, while being smoothed by correcting the curling behavior thereof. In this way, the orifice plate 40 is manufactured with the laminate layer 14 laminated thereon.

Subsequent to the manufacture of the orifice plate 40 having the laminate layer 14 attached thereto, the epoxy resin bonding agent is transferred to the bonding surfaces 44*a* and 44*b* of the head main body 46 which is manufactured in the separate process as in the case of the previous embodiment.

Then, the laminate layer 14 attached to the orifice plate 40 is held by handling, and each of the extrusions 45 of the orifice plate 40 on the side opposite to the laminate layer 14 is positioned at the leading end portion of each flow path 61 by allowing each of the extrusions 45 to enter each of the flow paths 61 corresponding to each of the extrusions 45. Here, clearance fit is adopted for fitting the extrusions 45 and flow paths 61.

In this case, as shown in FIG. 8B, a load of 1 kg/cm$^2$ is evenly applied from the laminate layer 14 to the orifice plate 40 to enable the orifice plate 40 to be closely in contact with the head main body 46. While keeping such state, the orifice plate 40 is heated at a temperature of 60° C. and pressed to the head main body 46, hence hardening the bonding agent to complete the process. In this respect, it may be possible to cut only the orifice plate 40 in advance, and then, cut out the orifice plate 40 from the laminate layer 14 at the same time of executing the pressurized bonding.

Now that the laminate layer 14 is laminated on the face plane of the orifice plate 40 as described above, the face plane of the orifice plate 40 follows the flat surface of the laminate layer 14. As a result, the orifice plate 40 is bonded to the head main body 46, while keeping its flatness in good condition. In case of the present embodiment in particular, the extrusions 45 on the orifice plate 40 side can enter the flow paths 61 on the head main body 46 side, hence making it possible to prevent the extrusions 45 and the discharge ports 41 from being deformed or damaged when bonded under pressure. Also, the water repellent layer of the face plane is protected by the presence of the laminate layer 14. There is no fear that the water repellent layer is broken when bonded under pressure.

The laminate layer 14 is formed by resin material or by stainless steel. When the laminate layer is formed by resin material, the thickness of the laminate layer 14 is made sufficiently greater than that of the film of the orifice plate 40. Here, since the robustness of the laminate later 14 is greater, the face plane of the orifice plate 40 can follow the laminate layer 14 when bonded under pressure. As a result, the orifice plate 40 can be bonded with good flatness. Also, if the laminate layer 14 is formed by stainless steel, it becomes possible to provide a stronger robustness the resin material. Therefore, the flatness of the face plane of the orifice plate can be maintained in a better condition when bonded under pressure. Also, if the laminate layer is made by stainless steel or the one having a smaller voluminal resistance factor than that of the orifice plate, it becomes possible to prevent the resins which become the orifice plates themselves from being closely in contact with each other. This may present an advantage that the post processes, such as the drilling and bonding, can be carried out in good condition.

Through the processes described above, the laminate layer 14 is peeled off, thus manufacturing the liquid discharge head shown in FIG. 3 and FIG. 4.

Figure 12:
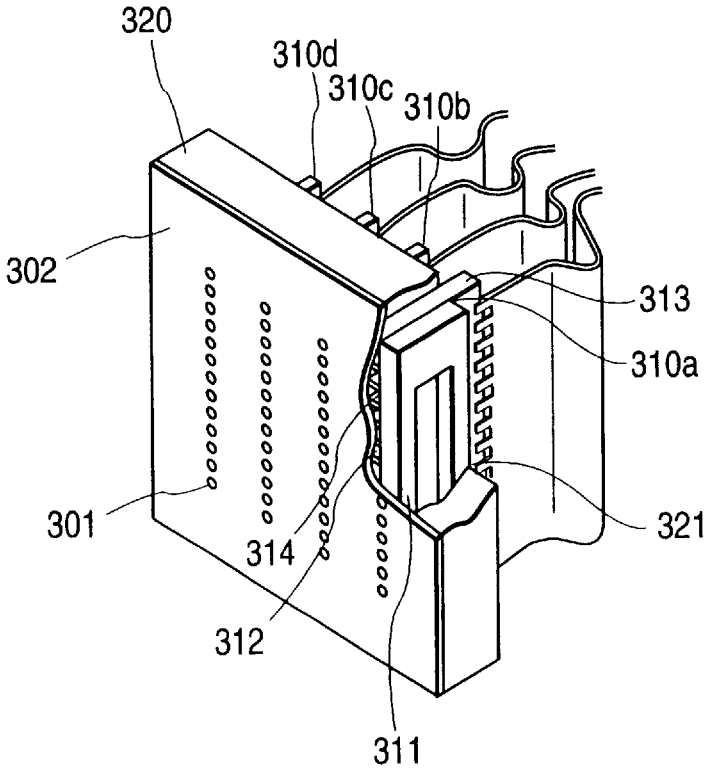
FIG. 12 is a perspective view which schematically shows a further embodiment of a liquid discharge head in accordance with the present invention.

FIG. 12 is a perspective view which schematically shows the liquid discharge head in accordance with one embodiment of the present invention.

As shown in FIG. 12, the head of the present embodiment comprises an orifice plate 302 having a plurality of orifices 301 that discharge ink; the head units 310*a* to 310*d* each arranged per color, which are bonded to the orifice plate 302 to supply ink to be discharged from each of the orifices 301; and the head unit inserting portion 321 where the head units 310*a* to 310*d* are inserted. Then, the head is structured with the frame (also referred to as the "base") 320 which is bonded to the orifice plate 302. Each of the head units 310*a* to 310*d* is communicated with each of the orifices 301. Then, the head is structured with the ceiling plate 311 that forms the flow paths 312 for supplying ink to be discharged from the orifices 301, and also, forms the liquid chamber and the supply port for supplying liquid to each of the flow paths 312, and the Si elemental substrate 313 provided with the energy generating elements 314 to generate energy for discharging from each of the orifices 301 the ink which has been supplied to each of the flow paths 312; and the Al wiring to supply electric signals to the energy generating elements by the application of the film formation technologies and techniques. Here, the flow paths 312 are formed by bonding the ceiling plate 311 thus arranged, and the elemental substrate together. Here, the flow paths 312 on the opposite side to the orifices 301 are communicated with the liquid chamber, and ink in the liquid chamber is supplied to the orifices 301 through the flow paths, respectively.

With the head units 310*a* to 310*d* bonded with the orifice plate 302, it is arranged that the orifice plate 302 is adhesively bonded to the aperture arrangement surface (hereinafter, referred to as the bonded surface with the head main body) where each of the flow paths 312 formed for each of the heat units 310*a* to 310*d*, respectively.

Here, for the orifice plate 302, it is preferable to use stainless steel (SUS), Ni or some other metallic films, or the plastic film which has an excellent resistance to ink, such as polyimide, polysulfone, polyether sulfone, polyphenylene oxide, polyphenylene sulfide, polypropylene, or some other resin film materials.

Also, for the orifice plate 302, the extrusions are provided in the arrangement direction of the flow paths 312, each corresponding to the sectional shape of each flow path 312. The extrusions are fitted into the flow paths 312, respectively. The structure thus formed, it becomes possible for the extrusions to regulate the deviation between the orifices 1 and the flow paths 312 that may be caused by the temperature changes due to the heat driving.

Also, in accordance with the present embodiment, the polysulfone (PSF) film of 50 $\mu$m thick is used as the orifice plate 302. Then, as the bonding resin used for bonding the orifice plate 302 and the head units 310*a* to 310*d*, the epoxy bonding agent is used, which can be hardened to the B stage, while maintaining the tack property by the UV irradiation, in order to complete the hardening and shrinkage, and then, to harden it more by further irradiation of UV or heating. In this respect, this bonding agent is used for bonding only by the application of the pressurized heating.

Now, hereunder, in conjunction with the accompanying drawings, the description will be made of the method for manufacturing the liquid discharge head which is structured as described above.

FIGS. 13A to 13D are views which illustrate the manufacturing process of the orifice plate of the liquid discharge head shown in FIG. 12.

Figure 13A:
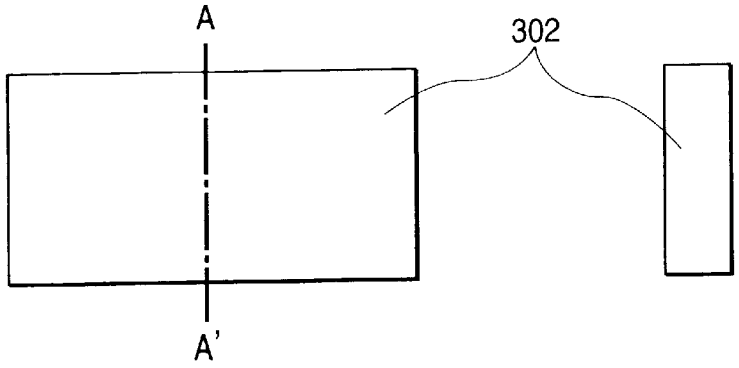
FIGS. 13A, 13B, 13C and 13D are views which illustrate the manufacturing process of an orifice plate for the liquid discharge head shown in FIG. 12.
Figure 13B:
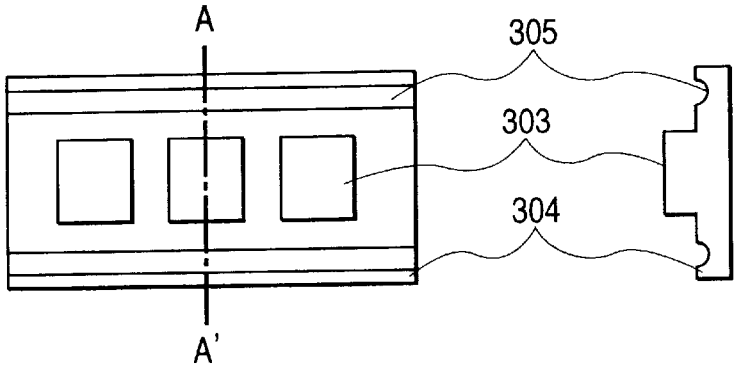
Figure 13C:
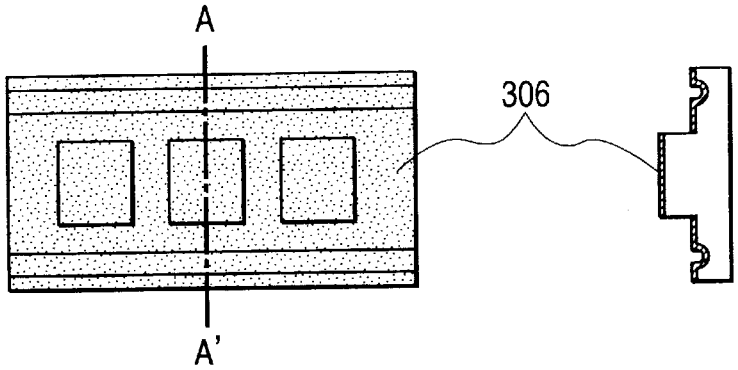
Figure 13D:
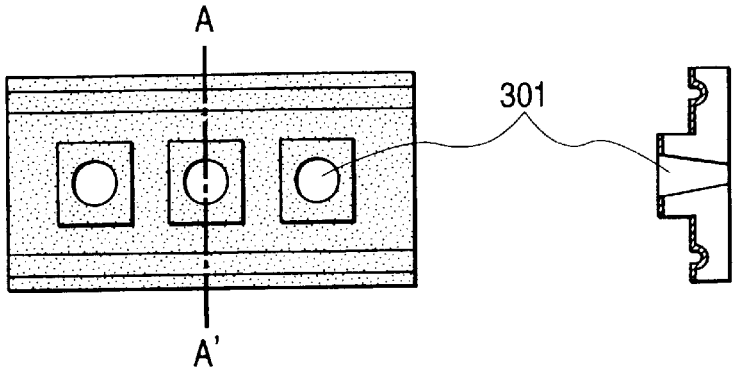
Figure 14A:
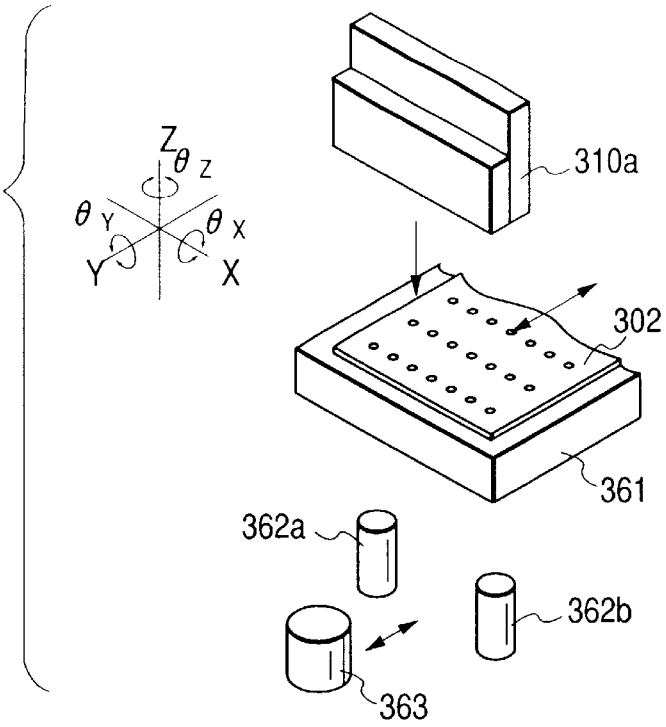
FIGS. 14A and 14B are views which illustrate the bonding process of the head units to the orifice plate manufactured in the steps shown FIGS. 13A to 13D.
Figure 14B:
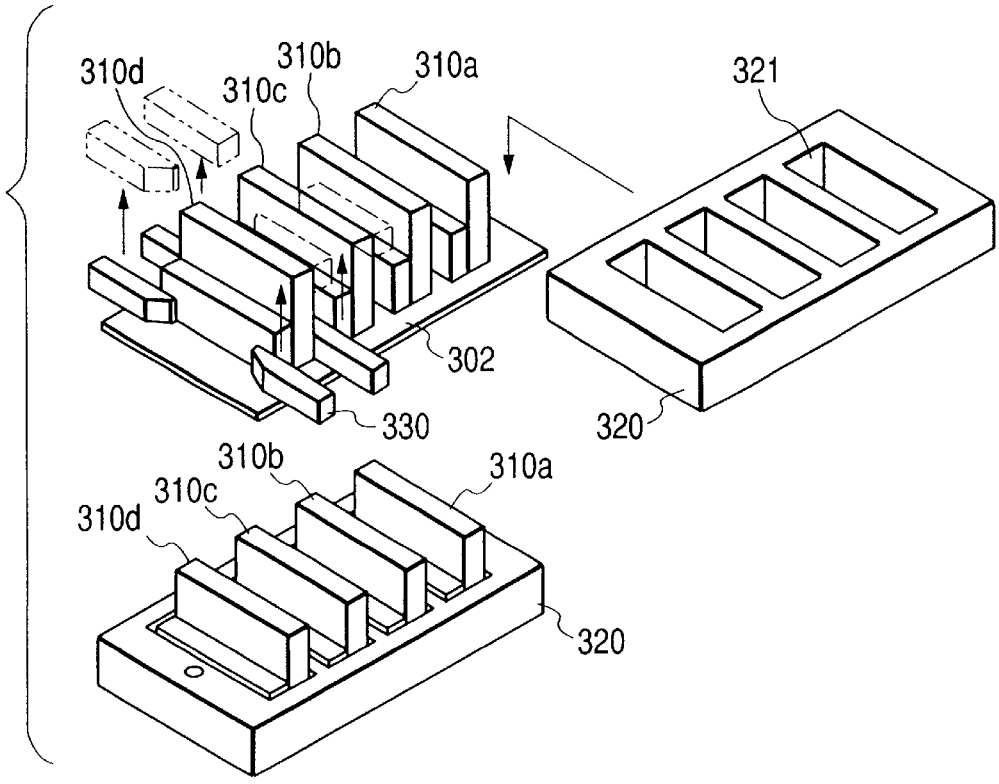

FIGS. 14A and 14B are views which illustrate the manufacturing process in which the orifice plate manufactured in the process shown in FIGS. 13A to 13D is bonded to the heat units; FIG. 13A is a view which shows the process for positioning the orifice plate to the head units; and 14B is a view which shows the process for bonding the frame to the orifice plate. Also, FIG. 15 is a view which shows the apparatus used for manufacturing the orifice plate in the process illustrated in FIGS. 13A to 13D.

Figure 15:
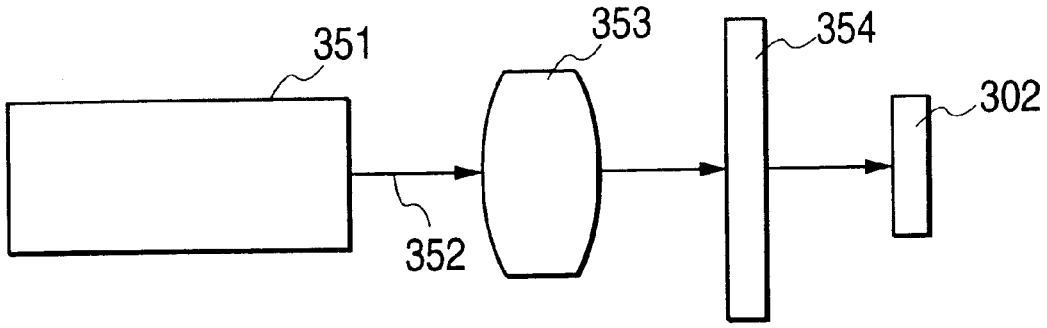
FIG. 15 is a view which shows the apparatus used for manufacturing the orifice plate represented in FIGS. 13A to 13D.

For processing the orifice plate 302 shown in FIG. 12, the apparatus shown in FIG. 15 is used with the KrF excimer laser beams of 248 nm wavelength in order to process the extrusions and recessed portions, grooves, and orifices.

The apparatus shown in FIG. 15 is formed by the excimer laser 351 which emits the KrF excimer laser beams 352 of 248 nm wavelength; the lens 353 that collects the laser beams 352 emitted from the excimer laser 351; and the mask 354 arranged between the excimer laser 351 and the orifice plate 302. The laser beams 352 emitted from the excimer laser 351 are irradiated to the orifice plate 302 through the lens 353 and the mask 354.

At first, the recessed portion 304 is made on the orifice plate 302 in a depth of 10 $\mu$m so that the dimension of the extrusion 303 is made to be 30 $\mu$m×30 $\mu$m, and also, a plurality of the extrusions 303 are arranged in straight line at intervals of 600 dpi. Then, in the recessed portion 304 positioned away from the extrusion 303 thus formed by 30 $\mu$m, the groove 305 of 20 $\mu$m wide is processed in a depth larger than that of the recessed portion 304 by 20 $\mu$m. Here, the recessed portion 304 and the groove 305 are formed to serve as the bonding surface with the head units 310*a* to 310*d* (see FIG. 13B).

Here, for the present embodiment, the description has been made of the case where the orifices are arranged in one line, but it is easy to manufacture a highly precise orifice plate usable for a plurality of head units by moving at specific pitches the stage having the orifice plate film fixed thereto for the continuous processing.

Then, the epoxy bonding agent 306 which can be used for bonding by the application of pressurized heating is coated evenly on the bonding surface of the orifice plate 2 with the head units by use of the transfer method after the hardening to the B stage by the UV irradiation and the completion of the hardening and shrinkage, while maintaining the tack property thereof. After that, the B stage treatment is made by the irradiation of the ultraviolet rays of 1 mW/cm$^2$ for a period of 60 seconds so as to complete the hardening and shrinkage of the bonding agent 306 (FIG. 13C).

Then, the orifice plate 302 thus processed in a series of steps described above is set on the orifice plate holder 361 of the bonding apparatus provided with the orifice plate holder 361; the observation systems 362*a* and 362*b*; and the ultraviolet irradiation lamp 363 as shown in FIG. 14A. Here, the orifice plate holder 361 is formed by a polished quartz glass so that the orifice plate 2 can be observed through glass by means of the observation systems 362*a* and 362*b*.

Subsequently, the bonding agent is transferred to the head unit clamping jig (not shown) which is set vertically and adjusted to the orifice plate holder 361, and the B staged head unit 310*a* is clamped, thus adjusting the X, Y, and θz axes by use of the observation systems 362*a* and 362*b*.

Then, the orifice plate 302 is sucked to be fixed to the substantially flat surface of the orifice plate holder (base) 361, and the X, Y, and θz axes of the orifice plate 302 are adjusted to be in agreement with the position of the head unit 310*a* which is stored in advance by the observation systems 362*a* and 362*b* across the orifice plate holder 361.

Then, the head unit 310*a* is lowered to form the orifices 301 of 22 $\mu$m diameter each on the extrusions 303 one by one (FIG. 13D).

After that, each extrusion 303 arranged on the circumference of the orifice is allowed to enter the flow path 312 of the head unit 310*a* which comprises the flow paths 312, the elemental substrate 313, and the ceiling plate 311 to bond the orifice plate 302 to the head unit 310*a*. Here, when the head unit 310*a* is lowered to bond the orifice plate 32 to the head unit 310*a* under pressure, the minute θy, and θx axes can follow the orifice plate 302. In this way, these are also bonded.

Then, the observation systems 362*a* and 362*b* are retracted. The ultraviolet irradiation lamp 363 is placed below the orifice plate holder 361 to irradiate specific ultraviolet rays for the completion of the hardening of the boding agent 306.

After each of the head units 310*a* to 310*d* is bonded and fixed to the orifice plate 302, the damper 330 that has clamped each of the head units 310*a* to 310*d* is released as shown in FIG. 14B, thus bonding the frame 320 and the orifice plate 302 after the head units 310*a* to 310*d* are inserted into the head unit inserting portions 321 of the fame 320, respectively. Here, in the head unit inserting portions 321, clearance is provided for each of them to the extent that no positional deviation occurs due to the interference that may be given to the head units 310*a* to 310*d* when the head units 310*a* to 310*d* are inserted.

The frame 320 is held when the it abuts upon the orifice plate 302. Then, silicone sealing agent is injected into the clearance provided for the head unit inserting portions 321. In this manner, the orifice plate 302 and each of the head units 310*a* to 310*d* are fixed, and each gap between them is filled.

Here, for the frame 320, the liquid supply ports are arranged corresponding to each of the liquid supply ports on the ceiling plates 311 of the head units 310*a* to 310*d*. Thus, the structure is formed to supply liquid to each of the head units 310*a* to 310*d* through these liquid supply ports, hence making it possible to provide a compact liquid discharge head at lower costs with the minimum number of parts.

Also, for the material of the frame 320, it is important to select the one having a lower linear expansion coefficient so that it is not easily expanded or deformed by the application of head, because the frame 320 holds the orifice plate 302. For such material, it is preferable to use aluminum oxide, silicon carbonate, silicon nitride, or the like, because any one of them is stable against various liquids, as well as to present the thermal stability.

Here, in accordance with the present embodiment, the extrusions that fit into the head units are formed on the orifice plate on the head bonding surface side, but if the material has a lower linear expansion coefficient, while being capable of suppressing the flow of the bonding agent into the flow paths, such material can be used for the orifice plate whose bonding surface is flat.

Now, with the liquid discharge head after the completion of the hardening of the bonding agent, printing is carried. Then, it is confirmed that the head is capable of obtaining an extremely high placement precision.

Subsequently, the recessed portion 304 is bonded by irradiating excimer laser beams from the orifice plate 302 on the bonded surface side with the head unit 310*a*.

In accordance with the present embodiment described above, the frame member that holds the orifice plate is bonded to the orifice plate after the orifice plate is bonded to the head units. However, it is also conceivable that the head units can be bonded to the frame which has been integrally formed with the orifice plate.

The structure of the present embodiment is the same as the one shown in FIG. 12, but the ceramic molded product which contains 99.5% alumina ($Al_2O_3$) is used as the material of the frame 320. The bonding surface thereof with the orifice plate 302 is finished by lapping, although it may be possible to use silicon, ceramics, resin of lower linear expansion coefficient, metal, or the like in consideration of the property of each of them that may regulate the thermal expansion of the orifice plate 302 and a higher mechanical strength. Each of them also makes it easier to obtain higher processing precision. In this respect, there is no problem that the frame and the orifice plate 302 are formed as one and the same member.

Now, hereunder, the description will be made of the method for manufacturing a liquid discharge head in accordance with the present embodiment. Here, the processing of the orifice plate 302 is the same as the method described in conjunction with FIGS. 13A to 13D. Therefore, the description thereof will be omitted.

FIGS. 16A to 16D are views which illustrate another example of the method for manufacturing a liquid discharge head in accordance with the present invention.

Figure 16A:
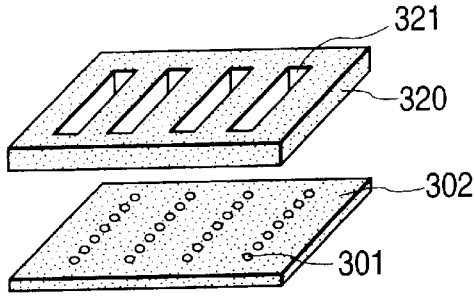
FIGS. 16A, 16B, 16C and 16D are views which shows another example of the manufacturing process of a liquid discharge head in accordance with the present invention.
Figure 16B:
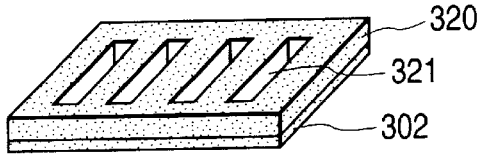

At first, on the frame 320 on the bonding surface side with the orifice plate 302, the same ???? polymer epoxy resin bonding agent which is used for bonding the head units and orifice plate 302 is coated in advance, and then, the B staged one is assembled (FIGS. 16A and 16B).

Here, for the head unit inserting portions 321 of the frame 320, intervals are set in consideration of the thickness tolerance of the head unit and the process tolerance of the frame, as well as the positioning precision between the frame 320 and the orifice plate 302 so that the inserting portion do not present any obstacles when the head units are incorporated with the orifices 301 which serves the criterion in this arrangement. Also, with the formation of the paths (not shown) on the frame 320 to supply liquid to the head units, it becomes possible to make the liquid discharge head more compact, and also, reduce the part numbers for the implementation of the manufacture at lower costs.

Figure 16C:
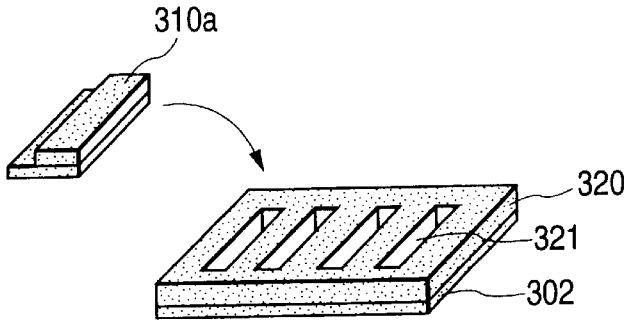
Figure 16D:
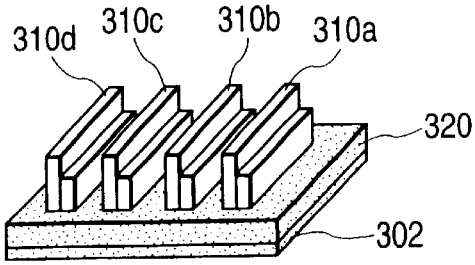

Then, each of the head units 310*a* to 310*d* for the respective colors is inserted into each head unit inserting portion 321 of the frame 320, thus positioning and bonding the orifices 301 of the orifice plate 302 arranged on the substantially flat surface of the orifice plate holder (base) with the flow paths 312 of the head units 310*a* to 310*d* in the same manner as the previous embodiment (FIGS. 16C and 16D). In this respect, it is preferable to fill the silicone resin whose hardening shrinkage is small in the gaps between the frame 320 and the orifice plate 302.

For the liquid discharge head manufactured by a series of processes described above, too, an extremely high placement precision is obtainable. Also, with the orifice plate 302 being supported by the frame 320, the head thus manufactured becomes stronger against mechanical shocks. Further, with the frame 320 having the ink supply paths arranged therefor, the liquid discharge head can be made more compact to contribute to making the printer main body smaller, besides the reduction of part numbers and the suppression of manufacturing costs.

Figure 17:
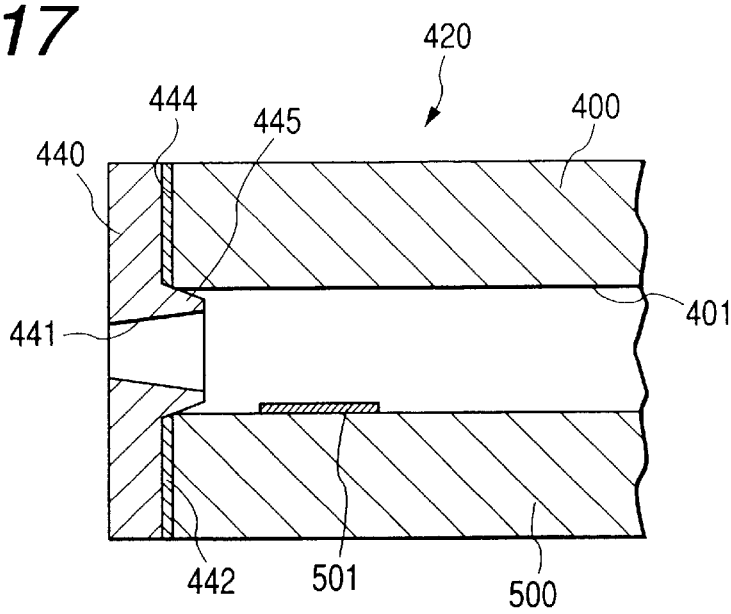
FIG. 17 is a cross-sectional view which schematically shows the principal part of a liquid discharge head in accordance with another embodiment of the present invention.
Figure 18:
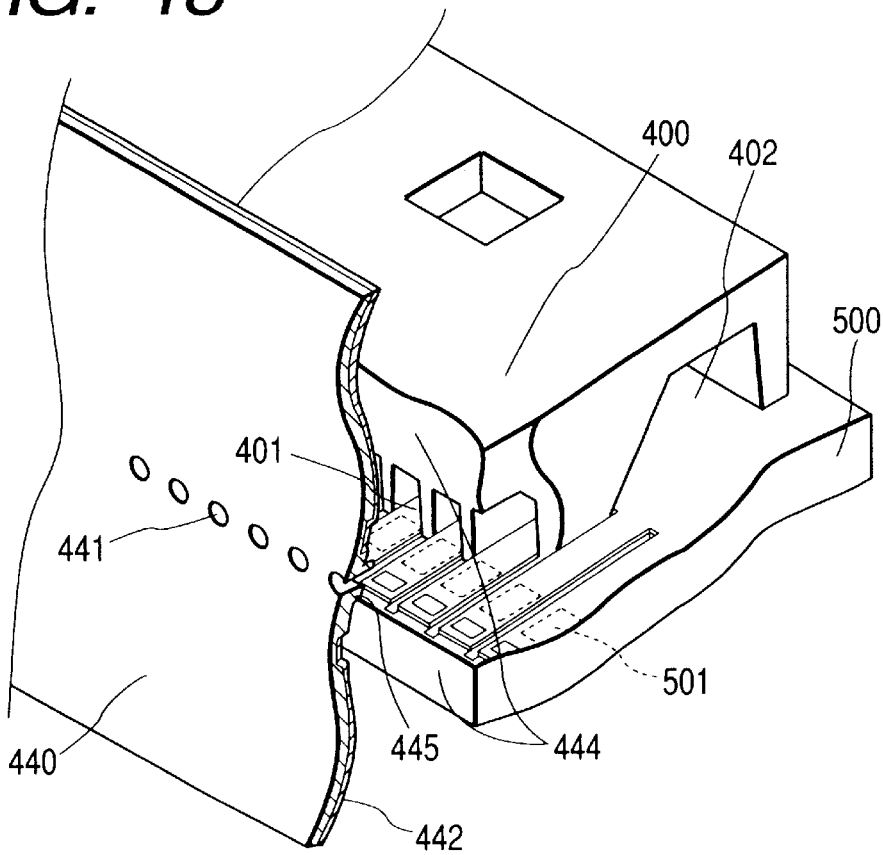
FIG. 18 is a cross-sectional view which shows a part of the liquid discharge head represented in FIG. 17.

FIG. 17 and FIG. 18 are views which illustrate the liquid discharge head in accordance with still another embodiment of the present invention. The head main body 420 is structured by bonding the ceiling plate 400, which is provided with the recessed portions to present grooves for the formation of a plurality of flow paths 401, and also, with a liquid chamber 402 communicated with these flow paths 401, together with the substrate (heater board) 500 formed on the silicon substrate by the application of the film formation technologies and techniques, which is provided with the energy generating elements (for the present embodiment, the heaters which serve as the heat generating elements) 501 for generating discharge energy, and also, with the aluminum wiring (not shown) to supply electric signals. Thus, with the ceiling plate 400 and the substrate 500 bonded together, the flow paths 401 and the liquid chamber 402 are formed between the ceiling plate 400 and the substrate 500.

The orifice plate 440 is bonded to the aperture arrangement surface 444 (the front face of the head main body 420) of each flow path 401 by use of the bonding agent 442. The orifice plate 440 of the present embodiment is formed by the polysulfone film whose thickness is 50 $\mu$m. For the orifice plate 440, each of the flow paths 401 and a plurality of discharge ports 441 communicated respectively with the flow paths are arranged. The extrusions 445, which are extruded respectively from the inner walls of the discharge ports 441 to the head main body 420 side, are integrally formed. Each of the extrusions 445 is allowed to enter the inner side of the tip aperture of each flow path 401. Each of the extrusions 445 and discharge ports 441 is tapered to be thinner toward the leading end thereof.

For this liquid discharge head, liquid (ink) is supplied from the liquid chamber 402 to each of the flow paths 401. Then, by driving means which is not shown, the flow path 401 is selected for discharging ink in accordance with the image to be formed. Then, driving signals are supplied to the corresponding heater 501 in the flow path 401 thus selected. The heater 501 that receives the driving signals generates heat. Ink in the flow path 401 is heated, and the heated ink bubbles. Thus, ink droplets are discharged from the discharge port 441 to the outside by means of the pressure exerted along the development of each of such bubbles. The ink droplets thus discharged to the outside adhere to a recording medium (recording paper sheet or the like) which is not shown to form images on the recording medium. In accordance with the present embodiment, the flow of ink is made smooth from each of the flow paths 401 to the discharge ports 441, and the discharge efficiency is good due to the formation of the extrusions 445.

In this respect, as the material of the orifice plate 440, it is preferable to use a metallic film, such as stainless steel, nickel, or a plastic film having an excellent resistance to ink, such as polyimide, polysulfone, polyether sulfone, polyphenylene oxide, polyphenylene sulfide, polypropylene, or some other resin film material.

Also, for the present embodiment, an epoxy bonding agent is used as the bonding agent 442 to bond the orifice plate 440 and the aperture arrangement surface 444 of the head main body 420. With the application of this bonding agent, the harding and shrinkage thereof is completed by the UV irradiation which effectuates the B staging of the bonding agent, while keeping its tack property, and then, with further UV irradiation or heating, it is hardened. Here, the aforesaid bonding agent 442 can be used for bonding only by the application of pressurized heating.

Now, the description will be made of the method for manufacturing a liquid discharge head in accordance with the present invention.

Figure 19:
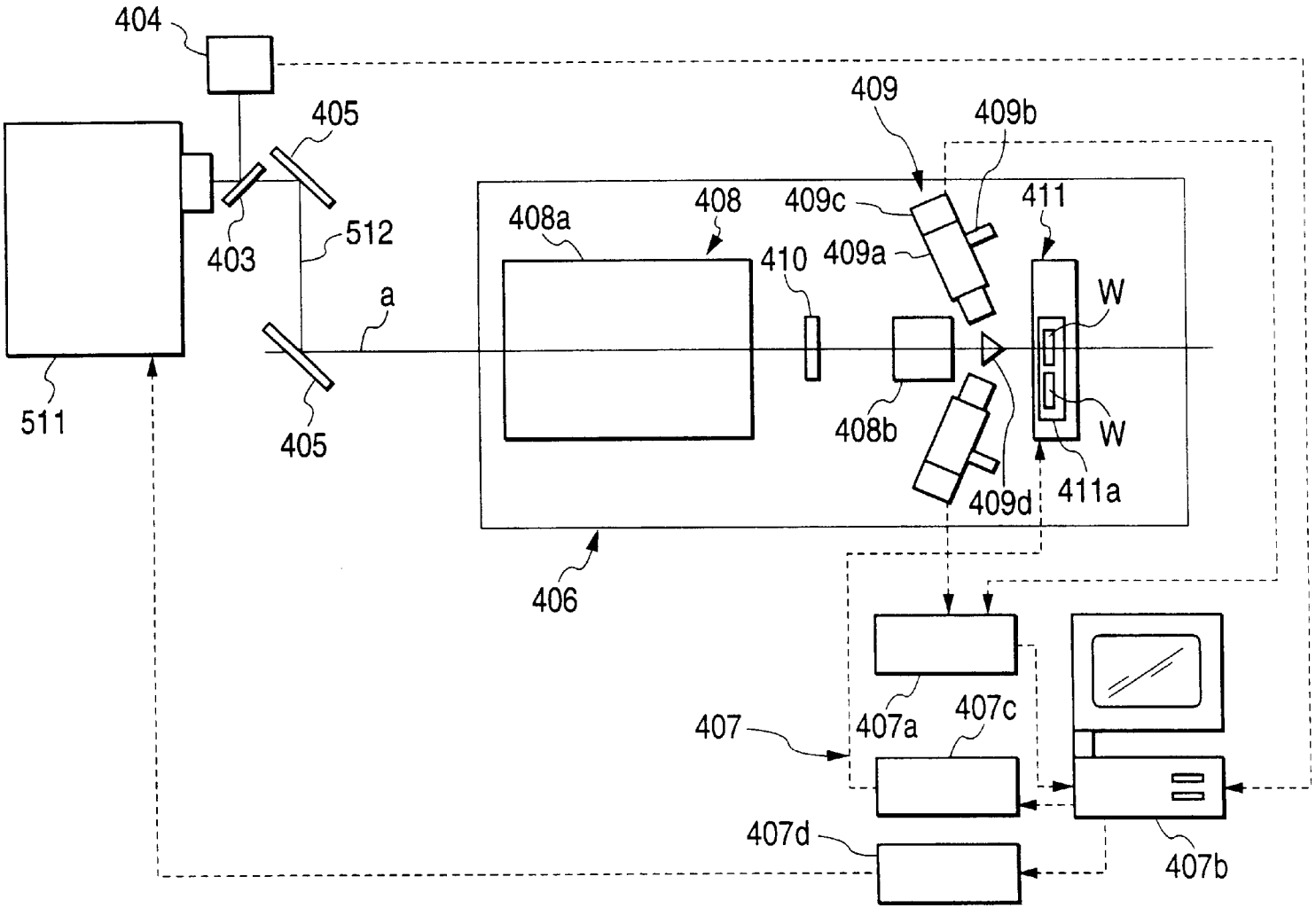
FIG. 19 is a view which schematically shows the laser processing apparatus used for manufacturing a liquid discharge head in accordance with the present invention.

FIG. 19 is a view which schematically shows the structure of the laser processing apparatus used for the manufacture of the liquid discharge head which is structured as described above. This laser processing apparatus comprises a laser oscillator 511 which serves as the laser light source that emits laser beams 512; the device frame 406 having the processing system arranged therefor to process a work W by means of the laser beams from the laser oscillator 511; and the information process and control systems 407 which process and control information of processing the work W.

As the laser oscillator 511 used by the laser processing apparatus, there is conceivably a YAG laser oscillator, the $Co_2$ laser oscillator, the excimer laser oscillator, the N2 laser oscillator, or the like, which has a high output. For the present embodiment, however, the Kr—F excimer laser oscillator is adopted, among those oscillators using excimer laser.

The device frame 406 comprises the optical system 408; the observation and measurement systems 409 that observes and measures the position of the work W; the mask 410; and the work station 411 that enables the work W to move. The optical system 408 comprises the beam shaping optical system and Koehler illumination system 408*a* arranged on the optical axis a of the laser beams 512 which are incident upon the device frame 406; the projection optical system 408*b* which focuses the images on the mask 410 on the processing surface of the work W. The mask 410 is arranged between the beam shaping optical system and Koehler illumination system 408*a* and the projection optical system 408*b*.

Figure 20:
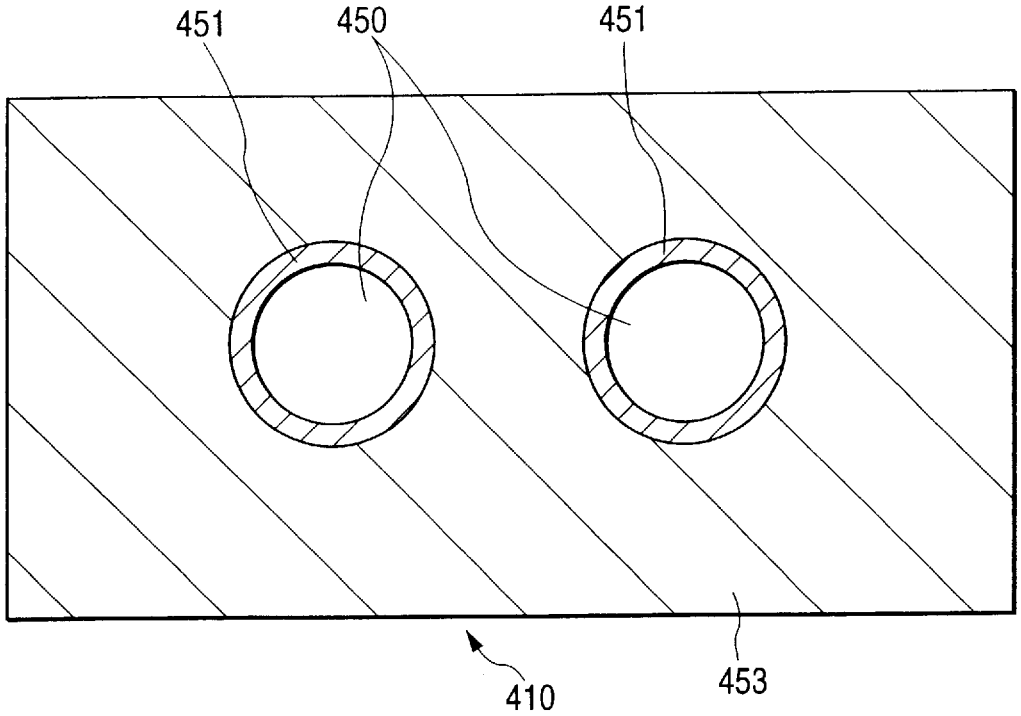
FIG. 20 is an enlarged view which shows a part of the mask used for manufacturing the liquid discharge head represented in FIG. 17.

FIG. 20 is an enlarged view which shows the mask 410. In accordance with the present embodiment, the laser transmissivity is locally changed per processing unit area for the mask 410 to process the orifice plate 440 of the liquid discharge head which is structured as described earlier. The transmissivity of the area (discharge port formation portion) 450 corresponding to the discharge port 41 shown in FIG. 17 is 100%; the transmissivity of the area (extrusion formation portion) 451 corresponding to the extrusion 445 is 0%; and the transmissivity of other portions 453 than those two areas is 30%.

In consideration of the durability of the mask 410, the projection optical system 408*b* should preferably be a reduction optical system. For the present embodiment, the projection optical system 408*b* is arranged with the reduction power to a ¼.

Although there is no detailed representation of the work station 411, it is preferable to provide an appropriate adjustment means in order to adjust the inclination of the work W to the aforesaid optical axis a. For example, the work station 411 may be structured with the combination of the stages having freedom as to five axes, that is, three axes which are orthogonal to each other, and two axes rotating around them. With the structure where the center for the rotational adjustment is brought to be in agreement with the center of processing the work W, it becomes possible to make the control of the adjustment means simpler.

It is also preferable to provide a plurality of standard pins for the jig 411*a* with which to mount the work W on the work station. Then, the work W on the work station 411 is allowed to abut upon them to position the work W on the work station 411 properly. Also, it is preferable to arranged on the jig 411*a* a clamping mechanism, such as air suction system, besides the aforesaid abutting mechanism, to make the automatic supply of the work W to the work station possible by integrating these mechanisms with an automatic hand. Further, a plurality of work pieces W are set on the work station 411 at a time so as to shorten the time required for making them ready for processing. In this case, however, one axis in the rotational direction of the adjustment means cannot be arranged on the center of the work W. As a result, there is a need for changing the standard values at the time of measurement and at the time of the work W to move.

The observation and measurement systems 409 are structured with a double face mirror 409*d* arranged for a pair of observation devices and on the optical axis a. The observation device comprises the lens barrel 409*a* provided with the object lens; the down light illumination source 409*b* incorporated in the lens barrel 409*a*; and the CCD camera sensor 409*c* which is connected with the lens barrel 409*a*.

Each of the observation devices and the mirror 409*d* are arranged between the projection optical system 408*b* and the work station 411. When the laser beams are irradiated, the mirror 409*d* is placed outside the optical axis a. It is arranged that only when the measurements are made, the mirror moves onto the optical axis a. In accordance with the present embodiment, the movement of the mirror 409*d* is controlled by means of the air cylinder mechanism which is not shown.

To the information process and control systems 407, the data on the work W positions are retrieved from the observation and measurement systems 409, and the data on the beam power are fed back from the power detector 404. More specifically, the information process and control systems comprises the image processing system 407*a* connected with each of the observation devices; the control system 407*b* connected with the image processing system 407*a*; moving means 407*c* for moving the work W on the work station 411 connected with the control system 407*b*; and the interface 407*d* connected with the control system 407*b* and the laser oscillator 511.

Figure 21:
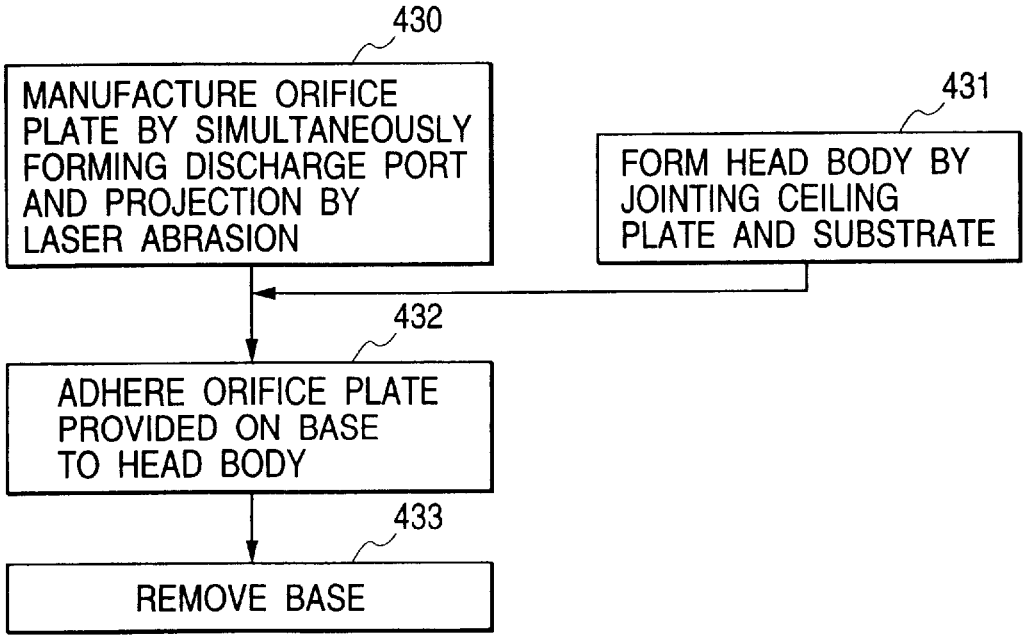
FIG. 21 is a flowchart which shows the method for manufacturing the liquid discharge head represented in FIG. 17.

FIG. 21 is a flowchart which shows the method for manufacturing a liquid discharge head. At first, the description will be made of the manufacture of the orifice plate 445 by use of the laser processing apparatus described above.

As the work W shown in FIG. 19, the polysulfone film that becomes the orifice plate 445 is set on the work station 411. Then, the laser beams 512 are irradiated from the laser oscillator 511. The laser beams 512 emitted from the laser oscillator 511 are partly reflected the beam splitter 403. The reflected beams are monitored by the power detector 404. On the other hand, the laser beams 512 which transmits the beam splitter 403 are reflected by the two 45° total reflection mirrors 405 to be incident upon the apparatus frame 406. Here, the beam splitter 403 is a parallel flat plate made of synthetic quartz, and only with the surface reflection, the laser beams 512 are partly split.

The laser beams 512 incident upon the apparatus frame 406 transmit the beam shaping optical system and Koehler illumination system 408*a*. Then, the images on the mask 410 are focused on the processing surface of the work W by use of the projection optical system 408*b*.

Figure 22:
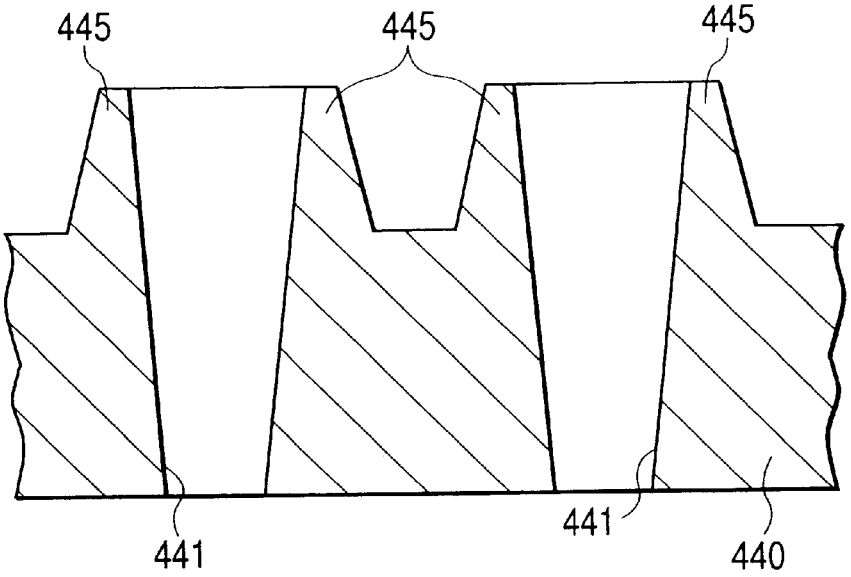
FIG. 22 is an enlarged sectional view which shows the orifice plate represented in FIG. 17.

In accordance with the present embodiment, the laser beams are irradiated at 200 to 400 puls of approximately 1 ($J/cm^2$·puls), and the polysulfone film is cut for processing by the application of ablation. As described earlier, the mask 410 is separated by the transmissivities of 100%, 30%, and 0%. The processing is made corresponding to these transmissivities. FIG. 22 is the enlarged sectional view of the orifice plate 440 thus processed. In other words, the portion whose transmissivity is 100% becomes the discharge port with the complete penetration of polysulfone. The one whose transmissivity is 30% is made thinner to a certain extent (for the present embodiment, the film of approximately 50 $\mu$m thick is cut by approximately 10 to 20 $\mu$m to make it 30 to 40 $\mu$m thick).

Then, the portion whose transmissivity is 0% is not cut so that it becomes each of the extrusions 445 relatively.

On the other hand, a part of the laser beams 512 irradiated from the laser oscillator 401 is reflected by the beam splitter 403 to be incident upon the power detector 404. Then, the data on the beam power are transferred from the power detector 404 to the image processing system 407*a* of the information process and control systems 407. After that, the result of the process by the image processing system 407*a* is transmitted to the control system 407*b*. Also, the data on the work W positions are retrieved from the CCD camera sensor 409*c* of the observation and measurement systems 409 to the control system 407*b* of the information process and control systems 407.

The control system 407*b* calculates the moved distance of the work W on the basis of the data and others thus supplied in order to actuate the moving means 407*c*. In this manner, the stage moves on the work station 411 with the work W mounted thereon, and when the data on the positions measured by the observation and measurement systems 409 become specific values, the positional adjustment by the moving means 407*c* is completed. The mirror 409*d* is removed from the optical axis a. Then, the signals are supplied to enable the laser oscillator 401 to emit laser beams 512 for a specific period of time or a specific number of pulses. Also, the beam power information from the power detector 404 is retrieved to the control system 407*b* where the output size given to the laser oscillator 511 is adjusted through the interface 407*d*. While a control of the kind is being carried out, the cutting process is executed for the polysulfone film by that application of the laser ablation as described earlier, hence forming the discharge ports 441, the extrusions 445, and the portions other than these two members. In this way, the manufacture of the orifice plate 440 is completed (step 430).

On the other hand, the ceiling plate 400 and the substrate 500, which are produced separately, are bonded in the laminated form by use for the bonding agent to constitute the head main body 420 (step 431). Then, on the aperture arrangement surface 444 of the head main body 420, the orifice plate 440 mounted on the flat surface of the base is pressed to be bonded by the application of the epoxy bonding agent 442 (step 432). Here, then, each of the discharge ports 441 is communicated with each of the flow paths 401. The extrusions 445 are positioned to be able to enter each of the flow path 401, respectively. After that, the head and the base are parted from each other (step 433).

Now, with reference to FIG. 23 to FIG. 25, the description will be made of still another embodiment in accordance with the present invention.

For the present embodiment, it is structure to form the groove 543 on the circumference of each extrusion 545 on the orifice plate 540. Any other structures than this arrangement are substantially the same as that of the previous embodiment. Therefore, the same reference marks are applied to the same structures as those of the previous embodiment, and the description thereof will be omitted.

For the orifice plate 540 of the present embodiment, there are formed integrally the discharge ports 541 that face the flow paths 401 of the head main body 420, respectively, and each extrusion 545 that extrudes from the inner walls of each discharge port 541 to the head main body 420 side. Each of the extrusions 545 and discharge ports 541 is tapered to become thinner toward the leading end thereof. Also, on the circumference of each extrusion 545, the groove 543 is formed.

Figure 24:
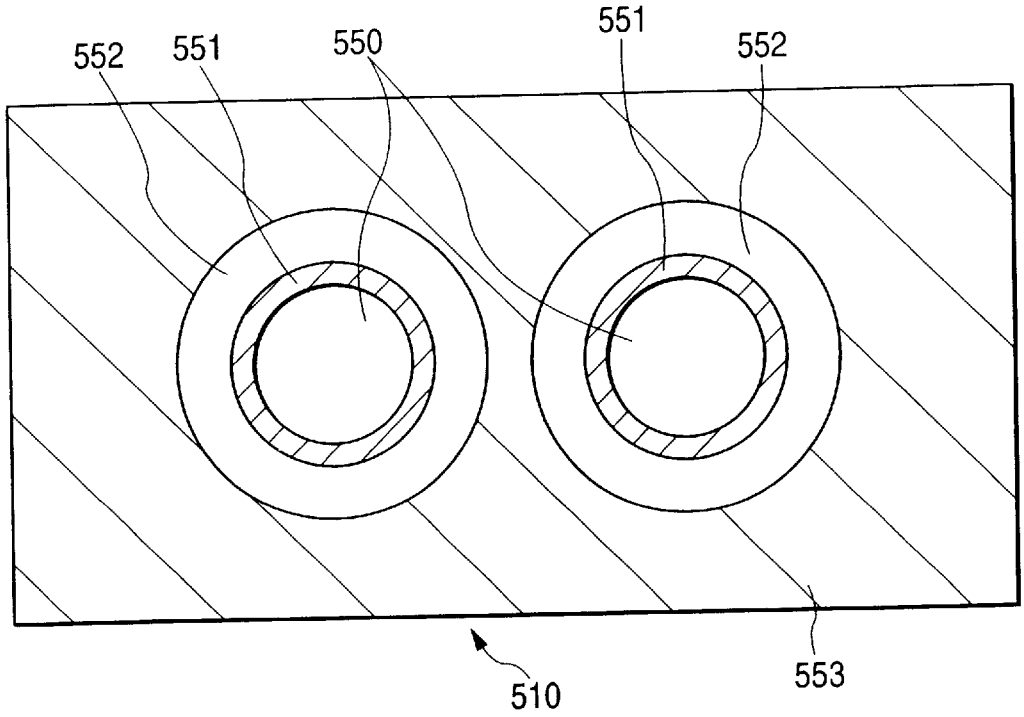
FIG. 24 is an enlarge view which shows a part of the mask used for manufacturing the liquid discharge head represented in FIG. 23.

As shown in FIG. 24, the mask 510 used for manufacturing the orifice plate 540 of the present is provided with the laser beam transmissivity per process unit area on the mask as follows: 100% for the area (the discharge port formation portion) 550 that corresponds to each discharge port 541; 0% for the area (the extrusion formation portion) 551 that corresponds to each extrusion 545; 100% for the area (the groove formation portion) 552 that corresponds to the groove 543 arranged for the circumference of each extrusion 545; and 30% for any other areas 553 than those mentioned above. Then, the laser beams are irradiated on condition of 200 to 400 puls of approximately 1 ($J/cm^2$·puls) to carry out the process by the application of laser ablation. As a result, the discharge ports 541, the extrusions 545, grooves 543, and other portions are formed. The thickness of the other portions is 30 to 40 $\mu$m.

Figure 25:
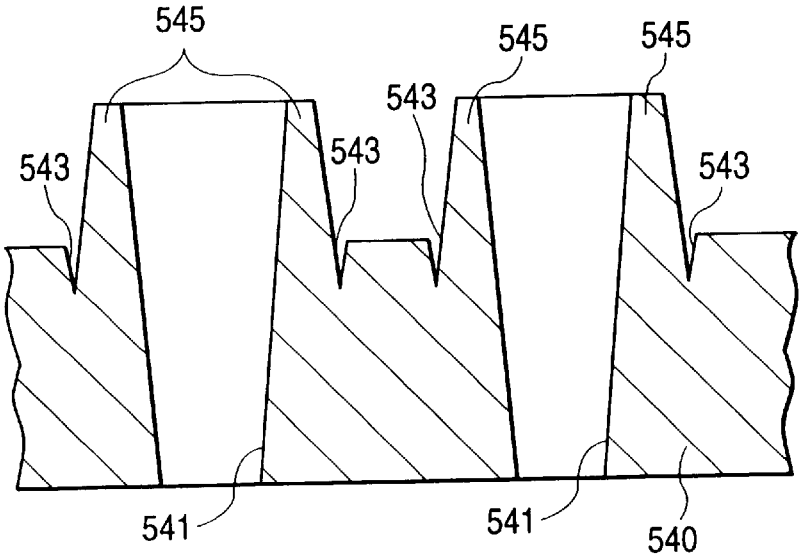
FIG. 25 is an enlarged sectional view which shows the orifice plate represented in FIG. 23.

Also, as shown in FIG. 25, the taper angle 549 from the extrusion 545 of the present embodiment to the groove 543 is smaller than the taper angle 448 from the extrusion 445 of the previous embodiment to the interior of the discharge port. Therefore, there is more room for the space where each extrusion 545 enters each flow path 401 of the head main body 420. This is because the higher the energy concentration, the smaller the taper angle tends to become in the general ablation processing, and the area 552 that faces the groove of the mask 543 has the higher laser beam transmissivity per process unit area 553 than the area that faces the recessed portion 546, hence having the highest energy amount per process unit area. Then, the groove 543 shown in FIG. 25 functions to be a groove for blocking any excessive amount of bonding agent to enter each of the flow paths 401 or the discharge ports 541 if the amount of the bonding agent should be excessive when the orifice plate 540 is bonded to the head main body 420.

Figure 23:
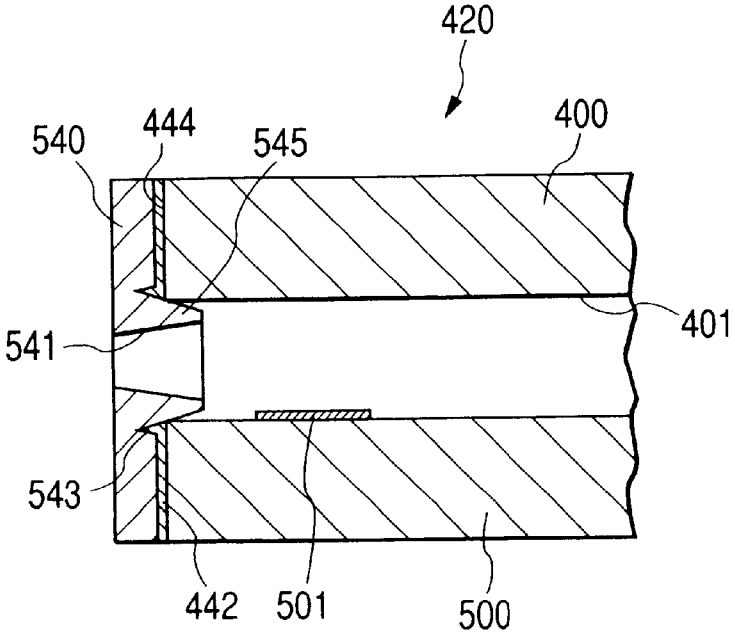
FIG. 23 is a cross-sectional view which schematically shows the principal part of a liquid discharge head in accordance with another embodiment of the present invention.

As shown in FIG. 23, the orifice plate 540 is adhesively bonded to the head main body 420 formed by bonding the ceiling plate 400 and the substrate together, hence completing the liquid discharge head.

Figure 26:
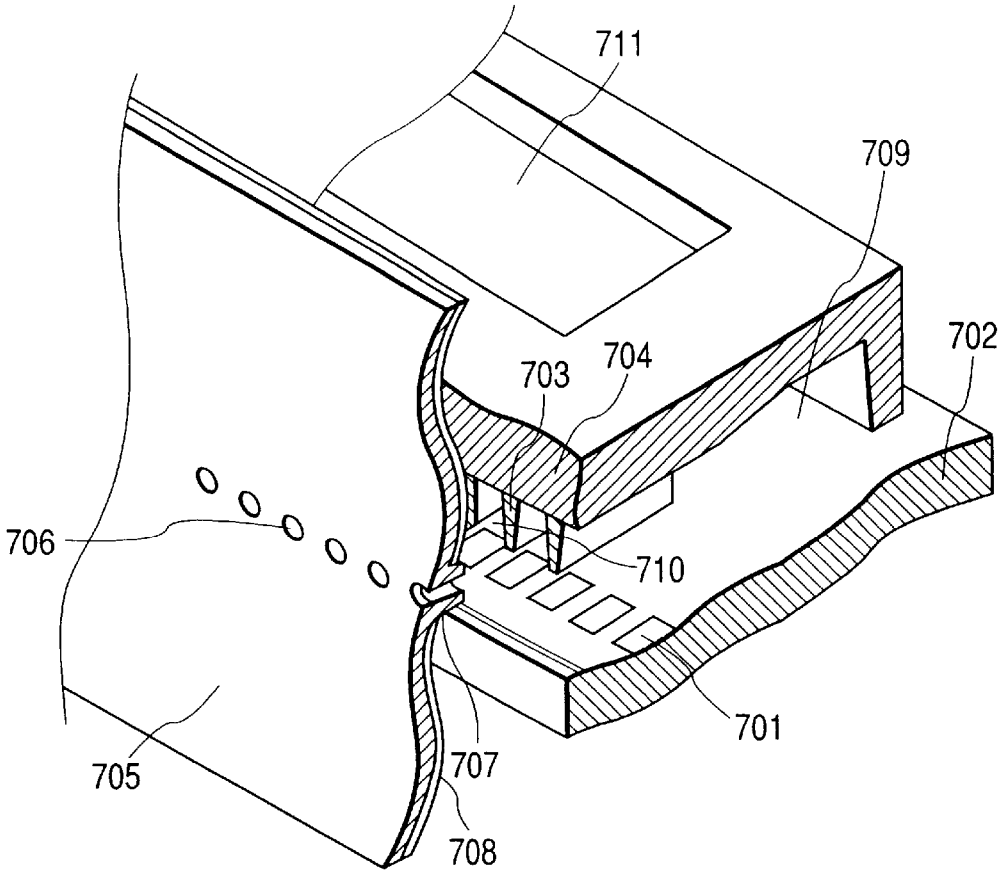
FIG. 26 is a partially broken perspective view which specifically shows the liquid discharge head to which the method of manufacture of the present invention is applicable.
Figure 27:
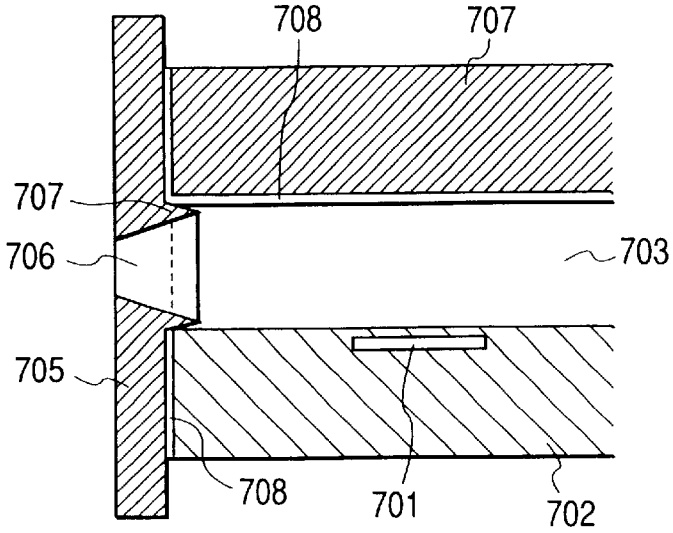
FIG. 27 is a cross-sectional view which shows the liquid discharge head manufactured by the method of manufacture in accordance with another embodiment of the present invention.
Figure 28A:
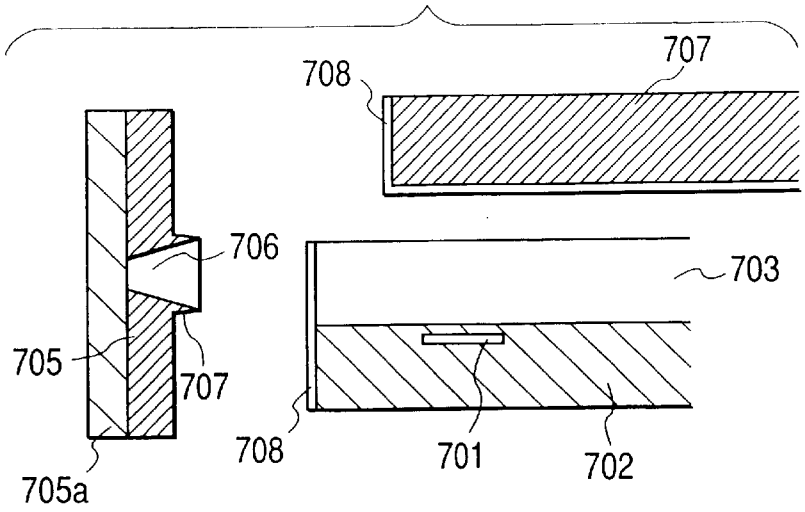
FIGS. 28A, 28B and 28C are views which illustrate the processes of a liquid discharge head in accordance with another embodiment of the present invention.
Figure 28B:
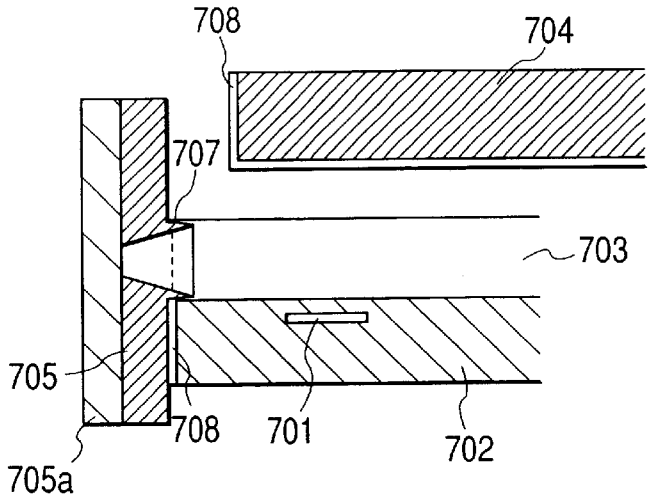
Figure 28C:
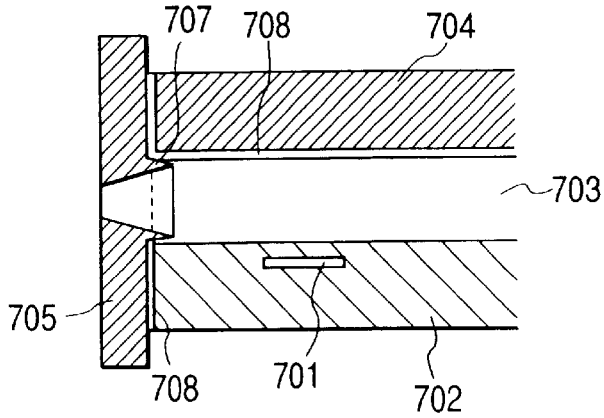

FIG. 26 is a partially broken perspective view which specifically shows the structure of the liquid discharge head to which the method of manufacture of the present invention is applicable. FIG. 27 is a cross-sectional view which shows the liquid discharge head manufactured by the method of manufacture in accordance with another embodiment of the present invention. FIGS. 28A to 28C are view which illustrate the processes of the method for manufacturing a liquid discharge head in accordance with another embodiment of the present invention.

The liquid discharge head shown in FIG. 26 comprises the ceiling plate 704 having the liquid chamber 709 and the ink supply port 711 formed thereon; the substrate 702 having heat generating element 701 severing as the discharge energy generating elements and Al wining to supply electric signals thereto, which are formed on the Si substrate by the application of the film formation technologies and techniques; the nozzle walls 703 arranged for the ceiling plate 704 or the substrate 702, being formed by bonding the flow paths 710 provided with the heat generating elements 701, the ceiling 704, and the substrate 702 together; and the orifice plate 705 bonded to the end portion of the bonded body of the ceiling plate 704 and the substrate 702 and provided with the discharge ports 706 formed for the flow paths 710, respectively. Further, on the circumference of each discharge port 706 of the orifice plate 705, each of the extrusions 707 is formed to enter each opening of the flow paths formed by bonding the ceiling plate 704 and the substrate 702 (see FIG. 27).

Now, the description will be made of the method for manufacturing a liquid discharge head in accordance with still another embodiment of the present invention.

At first, as shown in FIG. 28A, there are prepared the ceiling plate 704 having the liquid chamber and ink supply port (not shown) formed thereon, and the substrate 702 provided with the nozzle walls 703 that form a part of each flow path per heat generating element 701 by bonding it with the ceiling plate 704; and the orifice plate 705 arranged on the flat surface of the base 705*a* having the extrusions 707 each entering the opening of flow path per discharge port 706.

Then, as shown in FIG. 28B, the extrusions 707 are positioned to enter the grooves that form the flow paths between nozzle walls 703, respectively. Then, the substrate 702 is allowed to abut upon the orifice plate 705 for bonding. The bonding agent used for bonding the orifice plate 705 and the substrate 702 is epoxy bonding agent 708, which is coated in advance on the surfaces of the substrate 702 and nozzle walls 703 to be bonded with the orifice plate 705 (the thickness of the bonding agent is approximately 0.5 to 5 $\mu$m).

This process is to transfer the bonding agent coated evenly on a resin sheet or a rubber sheet to the bonding surfaces of the substrate 702 and the nozzle walls 703, and then, by the irradiation of ultraviolet rays (UV), irradiation of infrared rays, heating or some other treatment, the bonding agent is B staged, while keeping the tack property thereof, thus completing the hardening and shrinkage of the bonding agent.

As described above, after the orifice plate 705 and the substrate 702 are bonded, the bonding agent 708 used for the orifice plate 705 and the substrate 702 are hardened by the irradiation of ultraviolet rays (UV), or by combination of the UV irradiation and heating. Here, it may be possible to the UV or heat is given, while bonding the orifice plate 705 and the substrate 702 under pressure.

Then, as shown in FIG. 28C, the ceiling plate is bonded to the bonded body of the orifice plate 705 and the substrate 702, thus allowing the base 705*a* to be separated. The bonding agent 708 used for boding the ceiling plate 704 with the aforesaid bonded body is coated in advance on the bonding surface of the ceiling plate 704 with the orifice plate 705 and the nozzle walls 703. This coating is carried out by spraying the bonding agent directly to the ceiling plate 704 with the mask which covers the portions thereof where the coating is not required. Also, the bonding is carried out, while ceiling plate 704 is allowed to abut upon the orifice plate 705. After bonding, the bonding agent 708 between the ceiling plate 704 and the aforesaid bonded body is hardened by curing at 60° C. for 5 to 60 minutes. In this case, heat is applied, while the aforesaid bonded body and the ceiling plate 704 are in contact under pressure by use of spring. It may be possible to harden the bonding agent at a higher temperature for a shorter period of time.

After that, the ink tank (not shown) is connected with the ink supply port 711 shown in FIG. 26 to complete the liquid discharge head.

Figure 29A:
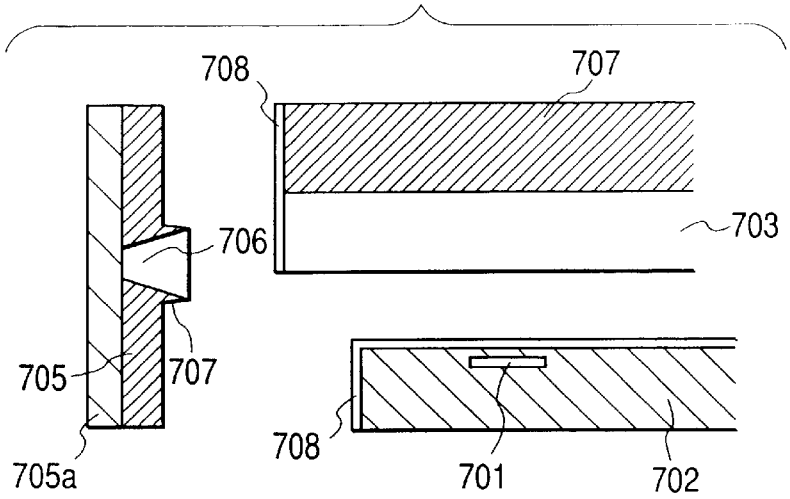
FIGS. 29A, 29B and 29C are views which illustrate the processes of a liquid discharge head in accordance with still another embodiment of the present invention.
Figure 29B:
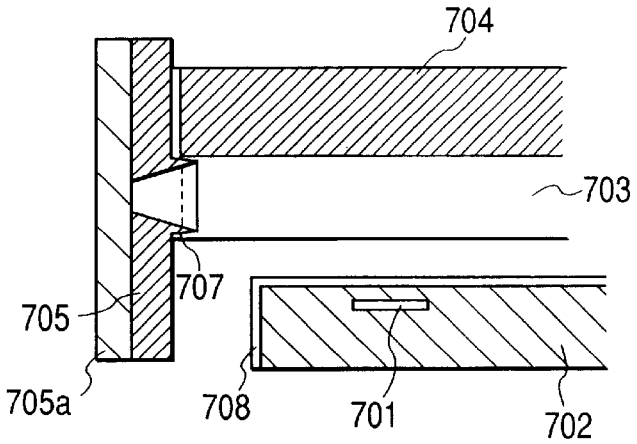
Figure 29C:
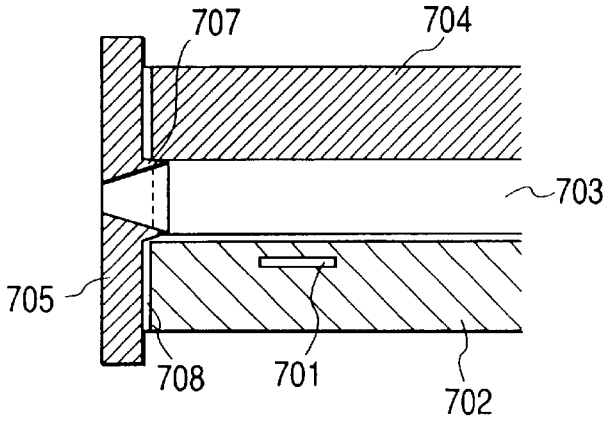

FIGS. 29A to 29C are views which illustrate the method for manufacturing a liquid discharge head in accordance with still another embodiment of the present invention.

Unlike the previous embodiment, the present embodiment uses, as shown in FIG. 29A, the orifice plate 705 which is provided with the substrate 702 having the heat generating elements 701 thereon; the ceiling plate 704 bonded with the substrate 702 to provide the nozzle walls 703 arranged to form a part of each flow path per heat generating element 701; and the extrusions 707 each entering the opening of each flow path per discharge port 706.

After these members are prepared, the extrusions 707 are positioned, as shown in FIG. 29B, to enter the grooves that form the flow paths between the nozzle walls 703, respectively. Then, the ceiling plate 704 is allowed to abut upon the orifice plate 705 for bonding. As the bonding agent 708 to bond the orifice plate 705 with the ceiling plate 704, the epoxy bonding agent is used by the same coating method as described in the previous embodiment. After bonding, the bonding agent is hardened by the UV irradiation, the application of heat, or by use of them in combination.

Then, as shown in FIG. 29C, the substrate 702 is bonded to the bonded body of the orifice plate 705 and the ceiling plate 704. The bonding is carried out with the substrate 702 being allowed to abut upon the orifice plate 705. The bonding agent 708 is applied and hardened by the same method as the previous embodiment when the substrate 702 is bonded to the aforesaid bonded body. At this juncture, heat is applied while aforesaid bonded body and the substrate 702 are in contact under pressure by use of spring.

Subsequently, the ink tank (not shown) is connected with the ink supply port 711 shown in FIG. 26 to complete the liquid discharge head.

Figure 30:
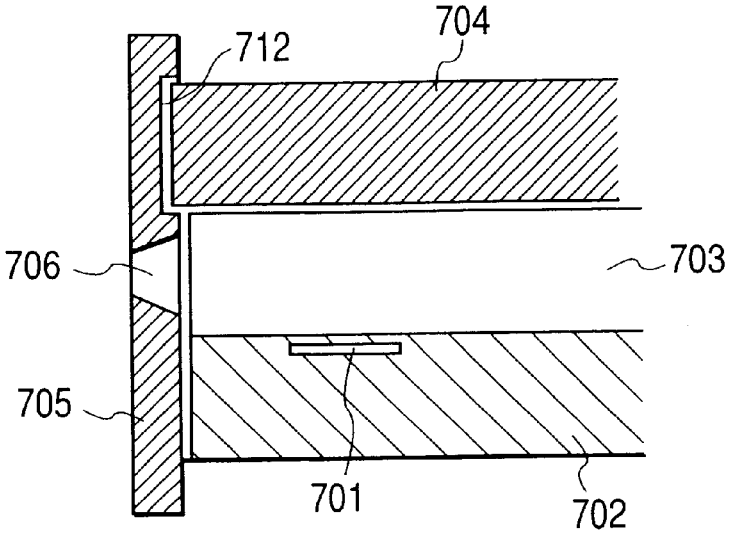
FIG. 30 is a cross-sectional view which shows a liquid discharge head in accordance with one embodiment of the present invention.
Figure 31:
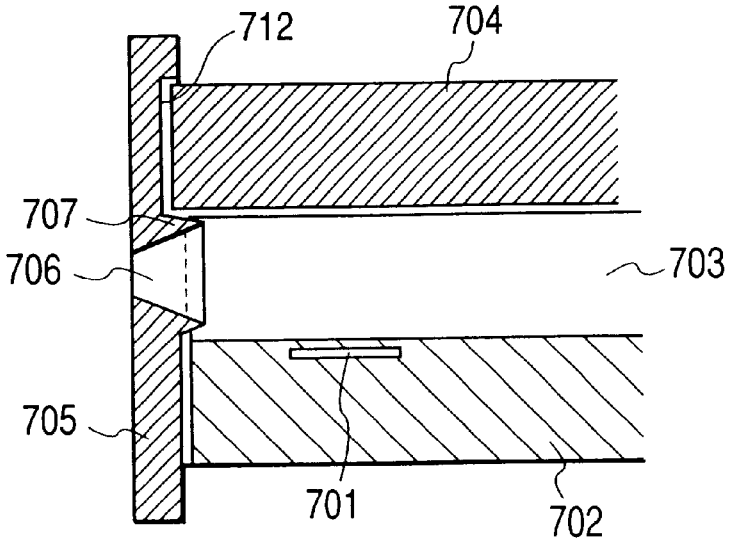
FIG. 31 is a cross-sectional view which shows a liquid discharge head in accordance with another embodiment of the present invention.
Figure 32A:
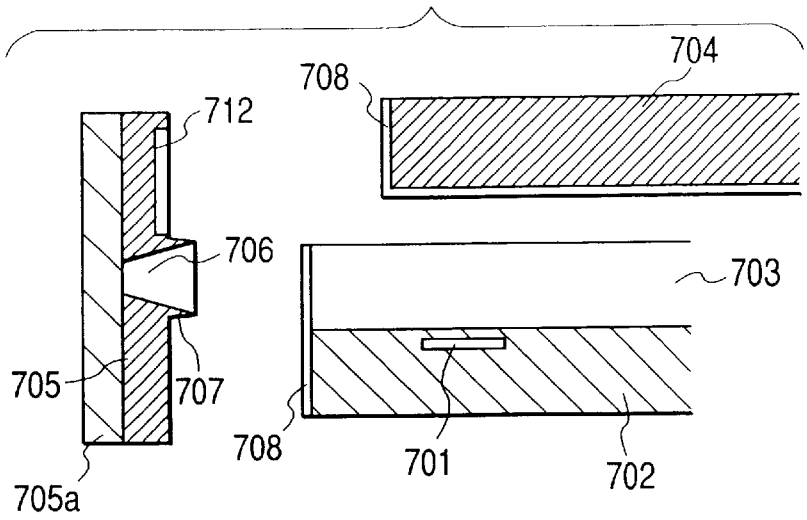
FIGS. 32A, 32B and 32C are views which illustrate the process of the method for manufacturing the liquid discharge head shown in FIG. 31.
Figure 32B:
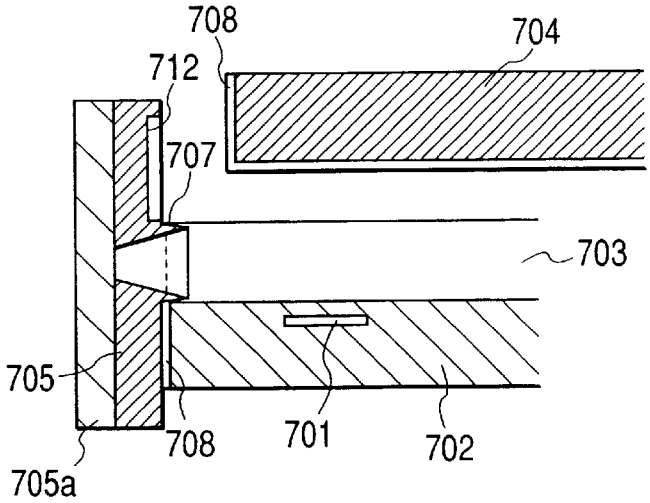
Figure 32C:
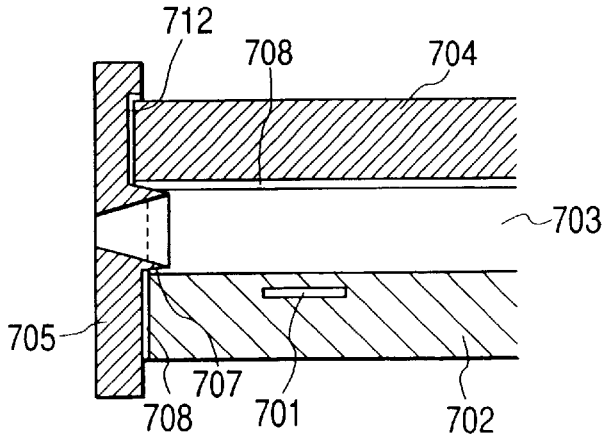

FIG. 30 is a cross-sectional view which shows one embodiment of the liquid discharge head of the present invention. FIG. 31 is a cross-sectional view which shows another embodiment of the liquid discharge head of the present invention. FIGS. 32A to 32C are views which illustrate each process of the method for manufacturing the liquid discharge head represented in FIG. 31.

The liquid discharge head shown in FIG. 30 comprises the ceiling plate 704 having the liquid chamber and the ink supply port (see FIG. 26) formed therefor; the substrate 702 having the Si substrate provided with the heat generating elements 701 which serve as discharge energy generating elements; the nozzle walls 703 provided for the substrate 702, which structure the flow paths for arranging heat generating elements 701 by bonding the ceiling plate 704 and the substrate 702; the orifice plate 705 bonded to the end portion of the bonded body of the ceiling plate 704 and the substrate 702, which is provided with each of the discharge ports 706 per flow path; and the cut-out portion 712 formed for the orifice plate 705 to receive the edge portion of the ceiling plate 704. As the material of the orifice plate 705, it is conceivable to use resin, metal, inorganic material, or the like. The cut-out portion 712 is formed by means of photolithography, laser processing, plating, etching, or the like.

Further, on the circumference of each discharge port 706 of the orifice plate 705, the extrusion 707 may be arranged to enter the aperture of each flow path formed by bonding the ceiling plate 704 and the substrate 702 as shown in FIG. 31.

Now, with reference to FIGS. 32A to 32C, the description will be made of the method for manufacturing the liquid discharge head represented in FIG. 31.

At first, as shown in FIG. 32A, there are prepared the ceiling plate 704 having the liquid chamber and ink supply port (not shown) formed thereon, and the substrate 702 provided with the nozzle walls 703 that form a part of each flow path per heat generating element 701 by bonding it with the ceiling plate 704; and the orifice plate 705 having the extrusions 707 each entering the opening of flow path per discharge port 706.

Then, as shown in FIG. 32B, the extrusions 707 are positioned to enter the grooves that form the flow paths between nozzle walls 703, respectively. Then, the substrate 702 is allowed to abut upon the orifice plate 705 for bonding. The bonding agent 708 used for bonding the orifice plate 705 and the substrate 702 is epoxy bonding agent, which is coated in the same manner as in the embodiment described earlier. After bonding, the bonding agent is hardened by the UV irradiation, the heat application, or by the combination thereof as in the previous embodiment.

Then, as shown in FIG. 32C, the ceiling plate 704 is bonded to the bonded body of the orifice plate 705 and the substrate 702. When bonding them, the ceiling plate 704 is positioned, while the orifice plate 705 is allowed to abut against the cut-out portion 712. The bonding agent 708 used for boding the ceiling plate 704 with the aforesaid bonded body is coated in the same manner as the previous embodiment, and hardened. At this juncture, heat is applied, while the aforesaid bonded body and the ceiling plate 704 are in contact under pressure by use of spring.

After that, the ink tank (not shown) is connected with the ink supply port 711 shown in FIG. 26 to complete the liquid discharge head.

The method that has been described above is equally applicable to the liquid discharge head shown in FIG. 30.

Figure 33:
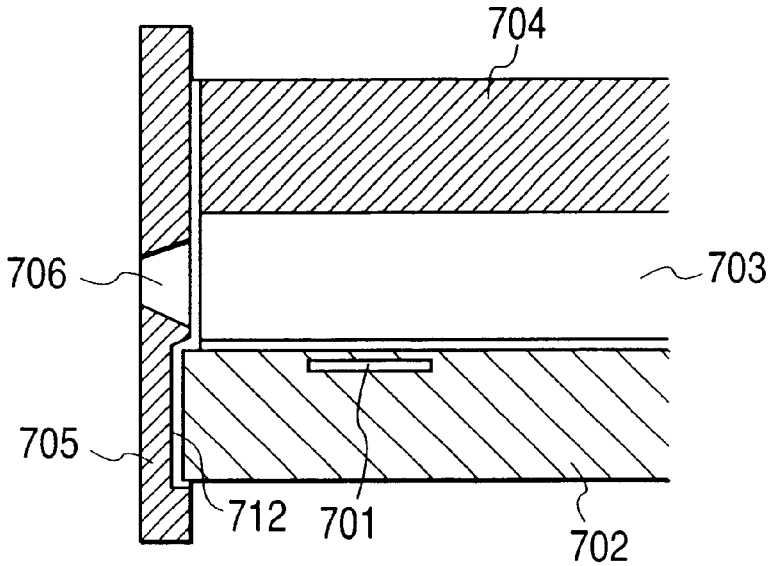
FIG. 33 is a cross-sectional view which shows a liquid discharge head in accordance with another embodiment of the present invention.
Figure 34:
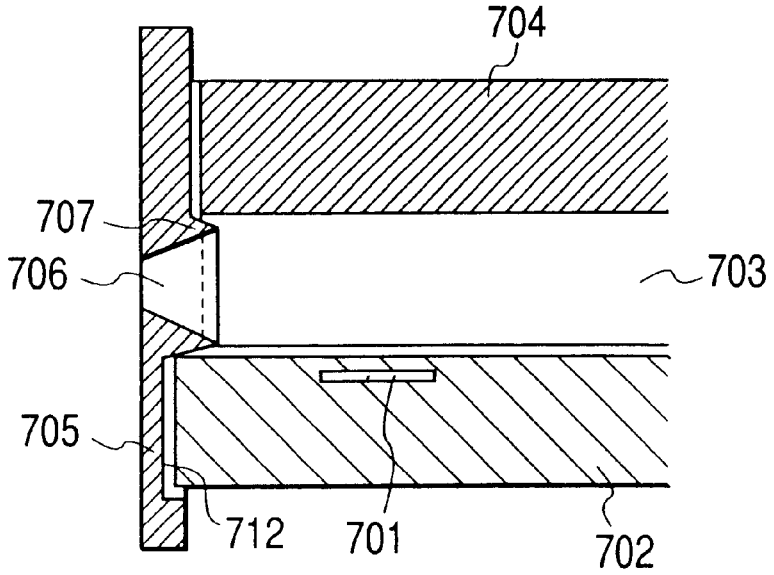
FIG. 34 is a cross-sectional view which shows a liquid discharge head in accordance with another embodiment of the present invention.
Figure 35A:
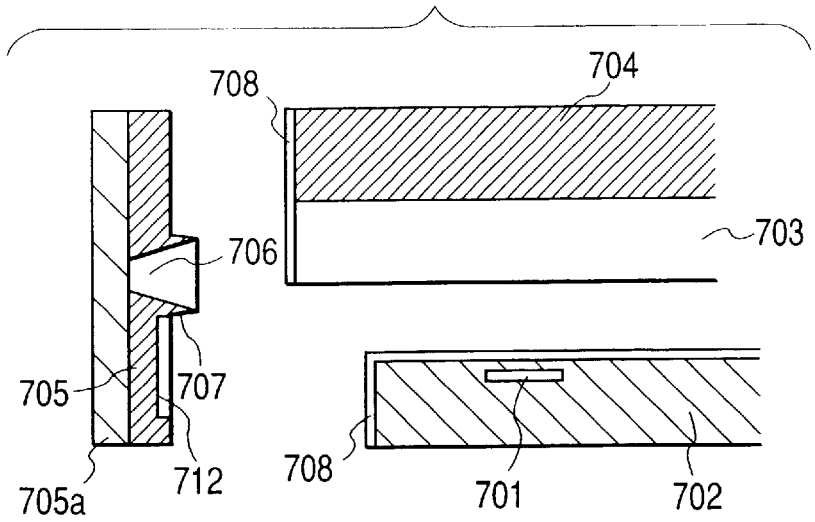
FIGS. 35A, 35B and 35C are views which illustrate the process of the method for manufacturing the liquid discharge head shown in FIG. 34.
Figure 35B:
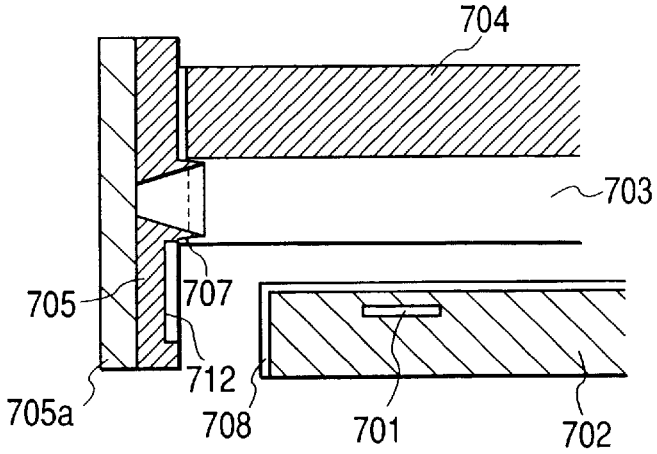
Figure 35C:
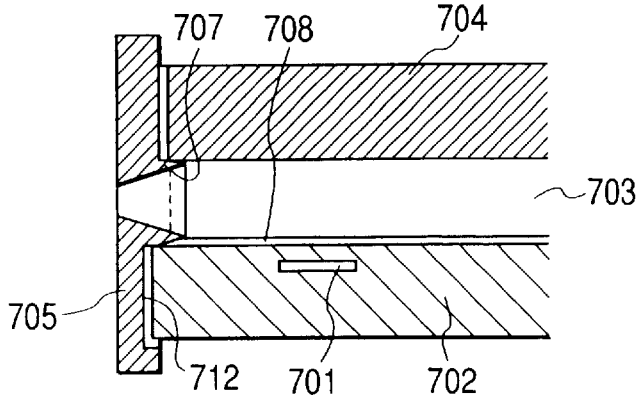

FIG. 33 and FIG. 34 are cross-sectional view which illustrate still another embodiment of the liquid discharge head in accordance with the present invention. FIGS. 35A to 35C are views which illustrate the processes of the method for manufacturing the liquid discharge head shown in FIG. 34.

The liquid discharge head shown in FIG. 33 comprises the ceiling plate 704 having the liquid chamber and the ink supply port (see FIG. 26) formed therefor; the substrate 702 having the Si substrate provided with the heat generating elements 701 which serve as discharge energy generating elements; the nozzle walls 703 provided for the ceiling plate 704, which structure the flow paths for arranging heat generating elements 701 by bonding the ceiling plate 704 and the substrate 702; the orifice plate 705 bonded to the end portion of the bonded body of the ceiling plate 704 and the substrate 702, which is provided with each of the discharge ports 706 per flow path; and the cut-out portion 712 formed for the orifice plate 705 to receive the edge portion of the substrate 702. As the material of the orifice plate 705, it is conceivable to use resin, metal, inorganic material, or the like. The cut-out portion 712 is formed by means of photolithography, laser processing, plating, etching, or the like.

Further, on the circumference of each discharge port 706 of the orifice plate 705, the extrusion 707 may be arranged to enter the aperture of each flow path formed by bonding the ceiling plate 704 and the substrate 702 as shown in FIG. 34.

Now, with reference to FIGS. 35A to 35C, the description will be made of the method for manufacturing the liquid discharge head represented in FIG. 34.

At first, as shown in FIG. 35A, there are prepared the substrate 702 provided with the heat generating elements 701; the ceiling plate 704 having the nozzle walls 703 that form a part of each flow path per heat generating element 701 by bonding it with the substrate 702; and the orifice plate 705 having the extrusions 707 each entering the opening of flow path per discharge port 706.

Then, as shown in FIG. 35B, the extrusions 707 are positioned to enter the grooves that form the flow paths between nozzle walls 703, respectively. Then, the ceiling plate 704 is allowed to abut upon the orifice plate 705 for bonding. The bonding agent 708 used for bonding the orifice plate 705 and the ceiling plate 704 is epoxy bonding agent, which is coated in the same manner as in the embodiment described earlier. After bonding, the bonding agent is hardened by the UV irradiation, the heat application, or by the combination thereof as in the previous embodiment.

Then, as shown in FIG. 35C, the substrate 702 is bonded to the bonded body of the orifice plate 705 and the substrate 702. When bonding them, the substrate 702 is positioned by allowing it to abut against the cut-out portion 712 of the orifice plate 705. The bonding agent 708 used for boding the substrate 702 with the aforesaid bonded body is coated in the same manner as the previous embodiment, and hardened. At this juncture, heat is applied, while the aforesaid bonded body and the substrate 702 are in contact under pressure by use of spring.

After that, the ink tank (not shown) is connected with the ink supply port 711 shown in FIG. 26 to complete the liquid discharge head.

The method that has been described above is equally applicable to the liquid discharge head shown in FIG. 33.

In this respect, the description has been made of the method of the present embodiment in which the ceiling plate 704 or the substrate 702 is bonded to the orifice plate 705, and then, to such bonded body, the remaining ceiling plate 704 or substrate 702 is bonded. However, the method may be such that the substrate 702 and the ceiling plate 704 are bonded at first, and then, the orifice plate 705 is bonded to such bonded body.

For this method, however, when the substrate 702 and the ceiling plate 704 are bonded, there may be created a step where the end portion of the ceiling plate 704 or the substrate 702 is protruded. In such a case, there is a need for the cut-out portion 712 of the orifice plate 705 should be formed deeper so that it can absorb the amount of the protrusion of such stepped portion. For that matter, it is desirable to adopt the method in which the orifice plate 705 and the ceiling plate 704 or the substrate 702 are bonded at first, because with this method, there is no need for considering the presence of such stepped portion.

If each of the embodiments are combined partly or totally for the implementation thereof, it becomes possible to demonstrate an excellent synergistic effect.

Figure 36:
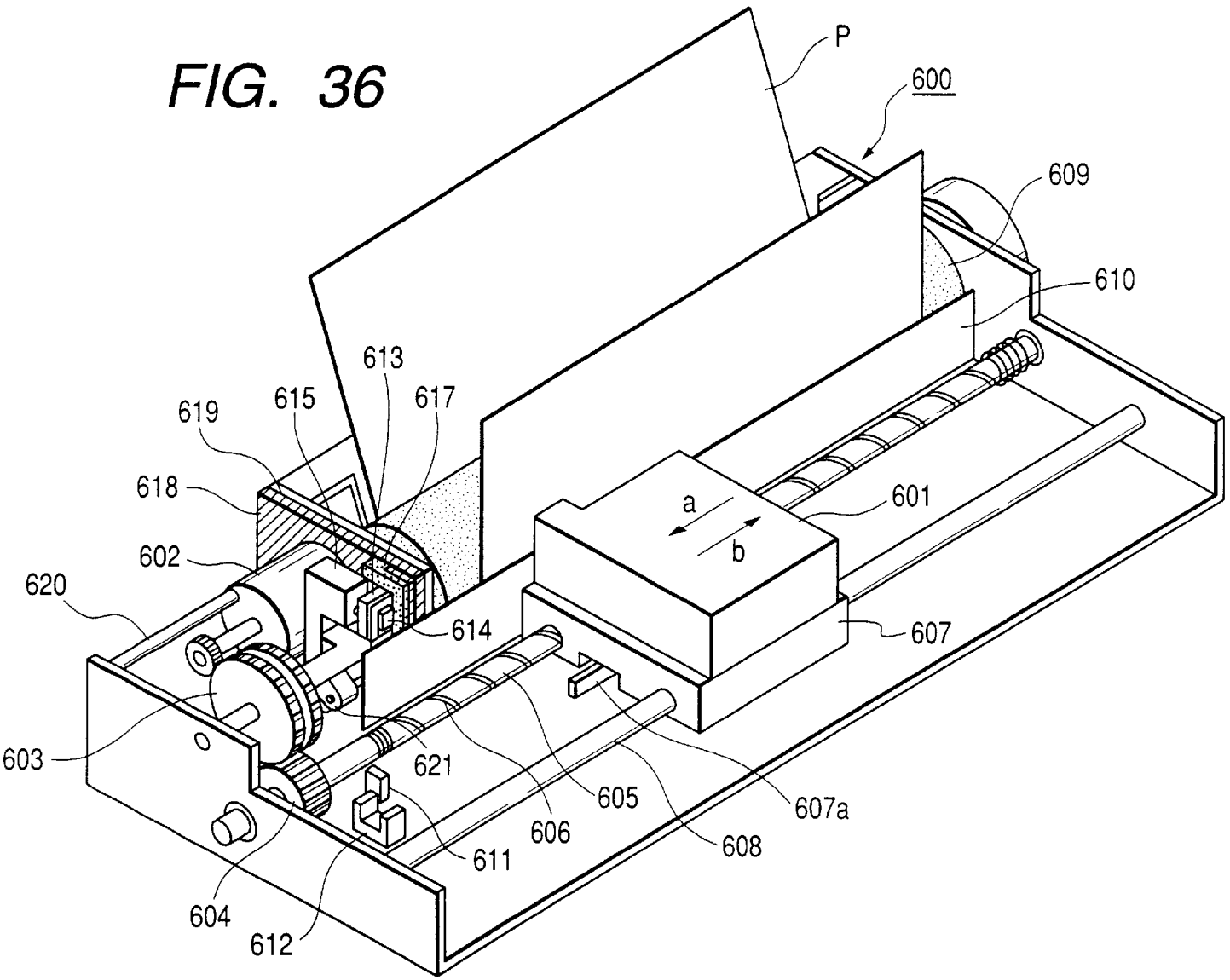
FIG. 36 is a perspective view which shows one example of the liquid jet recording apparatus having mounted thereon the liquid discharge head that uses the orifice plate obtained in accordance with the method of manufacture of the present invention.

FIG. 36 is a perspective view which shows an ink jet recording apparatus, that is, one example of the liquid discharge recording apparatus having mounted on it the liquid discharge head manufactured by use of the orifice plate described above. The head cartridge 601 mounted on the ink jet recording apparatus 600 shown in FIG. 36 is provided with the liquid discharge head manufactured by use of the orifice plate described above, and the liquid container that holds liquid to be supplied to the liquid discharge head. The head cartridge 601 is, as shown in FIG. 36, mounted on the carriage 607 which engages with the spiral groove 606 of the lead screw 605 driven through the driving power transmission gears 603 and 604 which are interlocked with the regular and reverse rotations of the driving motor 602. By the driving power of the driving motor 602, the head cartridge 601 can reciprocate together with the carriage 607 along the guide 608 in the directions indicated by arrows a and b. For the ink Jet recording apparatus 600 is provided with recording medium carrier means (not shown) to carry the printing sheet P which serves as the recording medium to receive liquid, such as ink, discharge from the head cartridge 601. The sheet pressure plate 610 for the printing sheet P, which is carried on the platen 609 By the recording medium carrier means, presses the printing sheet P to the platen 609 in the traveling direction of the carriage 607.

In the vicinity of one end of the lead screw 605, the photocouplers 611 and 612 are arranged. The photocouplers 611 and 612 are the means for detecting the home position which is arranged to recognize the presence of the lever 607*a* of the carriage 607 within the covering area of the photocouplers 611 and 612 so as to switch the rotational directions of the driving motor 602. In the vicinity of one end of the platen 609, the supporting member 613 is provided to support the capping member 614 that covers the front end of the discharge ports of the head cartridge 601. Also, the ink suction means 615 which sucks ink retained in the interior of the capping member 614 due to the idle discharges or the like of the head cartridge 601. With this ink suction means 615, the suction recovery of the head cartridge 601 is performed through the aperture of the capping member 614.

For the ink jet recording apparatus 600, the main body supporting member 619 is provided. Then, the moving member 618 is supported to the main body supporting member 619 movably in the forward and backward directions, that is, the traveling member is supported by movably in the direction at right angles to the traveling direction of the carriage 607. The moving member 618 is provided with the cleaning blade 617. The cleaning blade 617 is not necessarily limited to this mode. A cleaning blade of any other known mode may be adoptable. Further, the lever 620 is provided for the initiation of the suction of the suction recovery operation by ink suction means 615. The lever 620 moves along the cam 621 which engages with the carriage 607, and the movement thereof is controlled by known transmission means, such as clutch, to switch the driving power from the driving motor 602. The ink jet recording control unit, which supplies signals to the heat generating elements arranged for the head cartridge 601, and also, controls the driving of each of the aforesaid mechanisms, is provided for the ink jet recording apparatus main body. This unit is not shown in FIG. 36. For the ink jet recording control unit, driving signal supply means is provided to supply driving signals in order to discharge liquid from the liquid discharge head.

The ink jet recording apparatus 600 structured as described above performs recording on the printing sheet P carried on the platen 609 by the aforesaid means for carrying a recording medium, while the head cartridge 601 reciprocates over the entire width of the printing sheet P.

What is claimed is:

1. A method for manufacturing a liquid discharge head comprising the following steps of:

providing a head main body having liquid flow paths, and an aperture surface having flow path openings communicating with the liquid flow paths;

providing a discharge port plate having extrusions respectively on circumferences of inside openings communicating respectively with discharge ports and having grooves respectively on circumferences of the extrusions, the extrusions being on an inner face on a side opposite a discharge port surface provided with the discharge ports for discharging liquid, and a base having a joint surface in contact with the discharge port surface, the discharge port plate being arranged such that the discharge port surface and the joint surface are formed integrally to be in contact;

bonding the aperture surface and the inner face to fit the extrusions into the flow path openings by pressing the head main body and the base toward each other with the discharge port plate between them; and separating the base from other members.

2. A method for manufacturing a liquid discharge head according to claim 1, wherein the discharge ports are formed on an elongated resin film becoming the discharge port plate in said step of providing the discharge port plate.

3. A method for manufacturing a liquid discharge head according to claim 2, wherein the discharge ports are formed by a transfer formation of relief type, a laser processing, or by a combination thereof.

4. A method for manufacturing a liquid discharge head according to claim 2, wherein a laminated body having a laminate layer laminated on the resin film to become the base is cut in said step of providing the discharge port plate.

5. A method for manufacturing a liquid discharge head according to claim 4, wherein before the laminate layer is laminated on the resin film in said step of providing the discharge port plate, a water repellent layer is formed on the laminating surface of the laminate layer on the resin film.

6. A method for manufacturing a liquid discharge head according to claim 4, wherein the laminate layer is a resin sheet or a stainless steel sheet in a thickness sufficiently larger than that of the resin film.

7. A method for manufacturing a liquid discharge head according to claim 2, wherein the resin film is formed by extrusion molding or embossing formation.

8. A method for manufacturing a liquid discharge head according to claim 2, wherein the resin film is formed from thermoplastic polymeric material.

9. A method for manufacturing a liquid discharge head according to claim 2, wherein the resin film is formed from either one of polysulfone, polyether sulfone, polyphenylene sulfide, and polyether etherketone.

10. A method for manufacturing a liquid discharge head according to claim 1, wherein said bonding step is executed with the inclusion of a bonding agent between the head main body and the discharge port plate.

11. A method for manufacturing a liquid discharge head according to claim 1, wherein energy generating elements for generating energy utilized for discharging liquid are arranged in positions corresponding to the liquid flow paths of the head main body.

12. A method for manufacturing a liquid discharge head according to claim 11, wherein the energy generating elements are electrothermal transducing devices for creating film boiling in liquid by generating thermal energy.

13. A method for manufacturing a liquid discharge head according to claim 1, wherein the head main body is provided in plural units in said head main body providing step, and in said bonding step the plurality of head main bodies are arranged and bonded to the discharge port plate, which is shared by them for use.

14. A method for manufacturing a liquid discharge head according to claim 13, wherein the plurality of head main bodies and a frame supporting the plurality of head main bodies are fitted after said bonding step, but before said separating step.

15. A method for manufacturing a liquid discharge head according to claim 13, wherein the plurality of head main bodies and a frame supporting the plurality of head main bodies are fitted in said step of providing the discharge port plate.

16. A method for manufacturing a liquid discharge head according to claim 14 or claim 15, wherein silicone resin is filled in a gap between the plurality of head main bodies and the frame.

17. A method for manufacturing a liquid discharge head according to claim 1, wherein the discharge ports and the extrusions are formed almost simultaneously in said step of providing the discharge port plate.

18. A method for manufacturing a liquid discharge head according to claim 17, wherein the discharge ports and the extrusions are formed by irradiation of laser beams.

19. A method for manufacturing a liquid discharge head according to claim 1, wherein the discharge ports, the extrusions, and the grooves on the circumference of the extrusions are formed almost simultaneously.

20. A method for manufacturing a liquid discharge head according to claim 19, wherein the discharge ports, the extrusions, and the grooves are formed by irradiation of laser beams.

21. A method for manufacturing a liquid discharge head according to claim 20, wherein the laser beams are irradiated through a mask, and given the transmissivity of the laser beams on a discharge port formation portion of the mask as A, the transmissivity of the laser beams on an extrusion formation portion as B, and the transmissivity of the laser beams on other portions than those two as C, the relationships thereof are A>C>B.

22. A method for manufacturing a liquid discharge head comprising, in the following order, the steps of:

providing a member for structuring a head main body having grooves becoming liquid flow paths, and an aperture surface having edge openings of the grooves;

providing a discharge port plate having extrusions respectively on circumferences of inside openings communicating respectively with discharge ports, the extrusions being on an inner face on a side opposite a discharge port surface provided with the discharge ports for discharging liquid;

bonding the aperture surface and the inner face to fit the extrusions into the edge openings by enabling the member for structuring the head main body and the discharge port plate to approach each other; and forming the liquid flow paths by bonding the member for structuring the head main body with a plate member for closing the grooves.

23. A method for manufacturing a liquid discharge head comprising, in the following order, the steps of:

providing a member for structuring a head main body having grooves becoming liquid flow paths, and an aperture surface having edge openings of the grooves;

providing a discharge port plate having inside openings communicating respectively with discharge ports, being on an inner face on a side opposite a discharge port surface provided with the discharge ports for discharging liquid;

bonding the aperture surface and the inner face to communicate the discharge ports with the edge openings by enabling the member for structuring the head main body and the discharge port plate to approach each other; and forming the liquid flow paths by bonding the member for structuring the head main body with a plate member for closing the grooves.

24. A method for manufacturing a liquid discharge head comprising, in the following order, the steps of:

providing a member for structuring a head main body having grooves becoming liquid flow paths, and an aperture surface having edge openings of the grooves;

providing a discharge port plate having recessed portions on an inner face on a side opposite a discharge port surface provided with discharge ports for discharging liquid;

bonding the aperture surface and the inner face to communicate the discharge ports with the edge openings by enabling the member for structuring the head main body and the discharge port plate to approach each other; and forming the liquid flow paths by bonding the member for structuring the head main body with a plate member by enabling the plate member for closing the grooves to abut against the inner face of the recessed portions.

25. A method for manufacturing a liquid discharge head according to any one of claims 22 to 24, wherein a bonding agent is used for bonding the aperture surface and the inner face and/or the member for structuring a head main body and the plate member.

26. A method for manufacturing a liquid discharge head according to claim 25, wherein the bonding agent is an epoxy bonding agent capable of being hardened by thermal energy, light energy, or by a combination of thermal energy and light energy.

27. A method for manufacturing a liquid discharge head according to claim 25, wherein the bonding agent is a bonding agent completing hardening and shrinkage thereof after being B staged by irradiation of ultraviolet rays or heat treatment.

28. A method for manufacturing a liquid discharge head according to claim 25, wherein the member for structuring a head main body is in contact with the plate member under pressure by use of a spring for being bonded.

29. A method for manufacturing a liquid discharge head according to any one of claims 22 to 24, wherein energy generating elements for generating energy utilized for discharging liquid are arranged in positions corresponding to the liquid flow paths of the plate member.

30. A method for manufacturing a liquid discharge head according to claim 29, wherein the energy generating elements are electrothermal transducing devices for creating film boiling in liquid by generating thermal energy.

31. A method for manufacturing a liquid discharge head according to any one of claims 22 to 24, wherein energy generating elements for generating energy utilized for discharging liquid are arranged in positions corresponding to the liquid flow paths of the member for structuring a head main body.

32. A method for manufacturing a liquid discharge head according to claim 31, wherein the energy generating elements are electrothermal transducing devices for creating film boiling in liquid by generating thermal energy.

33. A method for manufacturing a liquid discharge head comprising the steps of:

providing a member for structuring a head main body having grooves becoming liquid flow paths, and an aperture surface having edge openings of said grooves;

providing a discharge port plate having extrusions respectively on circumferences of inside openings communicating respectively with discharge ports and having grooves respectively on circumferences of the extrusions, the extrusions being on an inner face on a side opposite a discharge port surface provided with the discharge ports for discharging liquid, and a base having a joint surface in contact with the discharge port surface in an integrated state of the discharge port surface and the joint surface being in contact;

bonding the aperture surface and the inner face to fit the extrusions into the edge openings by pressing the member for structuring a head main body and the base toward each other with the discharge port plate between them;

forming the liquid flow paths by bonding the member for structuring the head main body with a plate member for closing the grooves; and separating the base from other members.

34. A liquid discharge head comprising:

a plurality of head main bodies having liquid flow paths, and an aperture surface provided with flow path openings communicating with said flow paths;

a discharge port plate having extrusions arranged respectively on circumferences of inner openings communicating respectively with discharge ports, and grooves arranged respectively on circumferences of said extrusions, said extrusions being on an inner face on a side opposite a discharge port surface having said discharge ports for discharging liquid, said plurality of head main bodies being arranged and bonded to said discharge port plate shared by them, and said aperture surface and said inner face being bonded to fit said extrusions into said flow path openings.

35. A liquid discharge head according to claim 34, wherein each direction of said flow paths of said plurality of head main bodies is substantially perpendicular to said discharge port plate.

36. A liquid discharge head according to claim 34, further comprising:

a frame for supporting said discharge port plate.

37. A liquid discharge head according to claim 36, wherein said discharge port plate and said frame are bonded.

38. A liquid discharge head according to claim 36, wherein said discharge port plate and said frame are formed from one and the same material.

39. A liquid discharge head according to claim 34, wherein said discharge port plate is formed from resin, silicon, ceramics, metal, or a compound material thereof.

40. A liquid discharge head according to claim 34, wherein energy generating elements for generating energy utilized for discharging liquid are arranged in positions corresponding to said flow paths of said head main body.

41. A liquid discharge head according to claim 40, wherein said energy generating elements are electrothermal transducing devices for creating film boiling in liquid by generating thermal energy.

42. A liquid discharge head comprising:

a head main body having liquid flow paths, and an aperture surface provided with flow path openings communicating with said flow paths;

a discharge port plate having extrusions arranged respectively on circumferences of inner openings communicating respectively with discharge ports, and grooves arranged respectively on circumferences of said extrusions, said extrusions being on an inner face on a side opposite a discharge port surface provided with said discharge ports for discharging liquid, said aperture surface and said inner face being bonded to fit said extrusions into said flow path openings.

43. A liquid discharge head according to claim 42, wherein said discharge ports and said extrusions are formed almost simultaneously by irradiation of laser beams.

44. A liquid discharge head according to claim 42, wherein energy generating elements for generating energy utilized for discharging liquid are arranged in positions corresponding to said flow paths of said head main body.

45. A liquid discharge head according to claim 44, wherein said energy generating elements are electrothermal transducing devices for creating film boiling in liquid by generating thermal energy.

46. A liquid discharge head comprising:

a member for structuring a head main body having a first aperture surface provided with grooves becoming liquid flow paths, and a second aperture surface provided with edge openings of said grooves;

a plate member for covering said grooves by being bonded to said member for structuring a head main body;

a discharge port plate having extrusions arranged respectively on circumferences of inner openings communicating with discharge ports, and grooves arranged respectively on circumferences of said extrusions, said extrusions being on an inner face on a side opposite a discharge port surface provided with said discharge ports for discharging liquid, said second aperture surface and said inner face being bonded to communicate said discharge ports with said edge openings, and said plate member being allowed to enter said recessed portions to be bonded with said member for structuring a head main body for the formation of said flow paths.

47. A liquid discharge head according to claim 46, wherein on said inner face, extrusions are arranged on circumferences of inner openings communicating with said discharge ports to be fitted into said edge openings.

48. A liquid discharge head according to claim 46, wherein energy generating elements for generating energy utilized for discharging liquid are arranged in positions corresponding to said liquid flow paths of said plate member.

49. A liquid discharge head according to claim 48, wherein said energy generating elements are electrothermal transducing devices for creating film boiling in liquid by generating thermal energy.

50. A liquid discharge head according to claim 46, wherein energy generating elements for generating energy utilized for discharging liquid are arranged in positions corresponding to said flow paths of said member for structuring a head main body.

51. A liquid discharge head according to claim 50, wherein said energy generating elements are electrothermal transducing devices for creating film boiling in liquid by generating thermal energy.

52. A method for manufacturing a discharge port plate used for a liquid discharge head comprising the steps of:

forming on an elongated resin film recessed portions for the formation of a plurality of discharge ports;

arranging a laminate layer on a surface of the resin film having no recessed portions for the formation of the plurality of discharge ports;

forming discharge ports at the recessed portions on the resin film;

bonding the resin film to a head main body; and removing the laminate layer.

53. A method for manufacturing a discharge port plate according to claim 52, wherein the laminate layer is formed from resin or metal having a voluminal resistance smaller than that of the resin film.

54. A method for manufacturing a discharge port plate according to claim 52, wherein the discharge ports are formed by irradiation of laser beams.

55. A method for manufacturing a discharge port plate according to claim 52, wherein extrusions are formed on circumferences of the recessed portions for the formation of the plurality of discharge ports in said step of forming the recessed portions for the formation of the plurality of discharge ports.

* * * * *